US011419459B2

(12) United States Patent
Millerd

(10) Patent No.: US 11,419,459 B2
(45) Date of Patent: Aug. 23, 2022

(54) METHOD AND APPARATUS FOR CONCEALING BODY SUPPORT

(71) Applicant: Chet Millerd, Laughlin, NV (US)

(72) Inventor: Chet Millerd, Laughlin, NV (US)

( * ) Notice: Subject to any disclaimer, the term of this patent is extended or adjusted under 35 U.S.C. 154(b) by 6 days.

(21) Appl. No.: 17/072,944

(22) Filed: Oct. 16, 2020

(65) Prior Publication Data

US 2021/0030213 A1 Feb. 4, 2021

Related U.S. Application Data

(63) Continuation of application No. 29/734,036, filed on May 8, 2020, now Pat. No. Des. 902,704, which is a continuation of application No. 16/197,887, filed on Nov. 21, 2018, now abandoned.

(51) Int. Cl.
*A47K 3/00* (2006.01)

(52) U.S. Cl.
CPC ..... *A47K 3/003* (2013.01)

(58) Field of Classification Search
CPC ..... A47K 3/003; A47K 3/002; A47K 17/022; A47K 17/02; A47K 17/026; A47K 17/028; A47K 13/105
See application file for complete search history.

(56) References Cited

U.S. PATENT DOCUMENTS

| | | | | |
|---|---|---|---|---|
| 1,074,133 | A | 9/1913 | Nuestaedter | |
| 4,241,472 | A | 12/1980 | Iannarone | |
| 4,953,241 | A | 8/1990 | Williams | |
| 5,533,601 | A | 7/1996 | Wang | |
| 5,816,374 | A | 10/1998 | Hsien | |
| 5,845,978 | A | 12/1998 | Jung | |
| 6,374,460 | B1 | 4/2002 | Edevold et al. | |
| 6,389,645 | B1 | 5/2002 | Polidoro | |
| 6,536,078 | B2 | 3/2003 | Tsai | |
| D548,560 | S | 8/2007 | Weinerman et al. | |
| 7,574,771 | B2 | 8/2009 | Cheng | |
| 7,594,684 | B2 * | 9/2009 | Hidaka | B60N 3/023 16/110.1 |
| D625,574 | S | 10/2010 | Burns | |
| 7,882,594 | B2 | 2/2011 | Ramsauer | |
| 8,015,669 | B2 | 9/2011 | Huang et al. | |
| 8,474,098 | B1 | 7/2013 | Yang | |

(Continued)

FOREIGN PATENT DOCUMENTS

GB 2461492 A 1/2010

*Primary Examiner* — Janie M Loeppke
(74) *Attorney, Agent, or Firm* — McKee, Voorhees & Sease, PLC

(57) ABSTRACT

A walk-in bathing environment is used by people who may have trouble getting in and out of standard bathtubs or showers. Rotatable grab bars are positioned in and around the bathing environments to aid in entering the environments, exiting the environments, sitting, standing, and otherwise moving relative to the bathing environment. The rotatable grab bars may be placed on the walls, top, external, or generally on and around the bathing environment such that a user can grab the one or more rotatable grab bars in order to provide support for moving relative to the bathing environment. The rotatable grab bars are connected to the environment such that they can be moved between a use and a non-use configuration, such that the rotatable grab bars are extending from a portion of the housing only when desired by the user.

15 Claims, 18 Drawing Sheets

(56) References Cited

U.S. PATENT DOCUMENTS

| | | | |
|---|---|---|---|
| 8,670,233 | B2 | 3/2014 | Huang et al. |
| D723,900 | S | 3/2015 | Bertani |
| D937,160 | S | 11/2021 | Ikeda et al. |
| 2003/0029974 | A1 | 2/2003 | Marshall et al. |
| 2004/0107486 | A1 | 6/2004 | Yoo |
| 2007/0283527 | A1 | 12/2007 | Cheng |
| 2016/0135649 | A1 | 5/2016 | Millerd |
| 2018/0084959 | A1 | 3/2018 | Hall et al. |

* cited by examiner

METHOD AND APPARATUS FOR CONCEALING BODY SUPPORT

CROSS REFERENCE TO RELATED APPLICATIONS

This is a continuation patent application which claims priority under 35 U.S.C. § 120 to U.S. Ser. No. 29/734,036, filed May 8, 2020, which was a continuation patent application claiming priority to U.S. Ser. No. 16/197,887, filed Nov. 21, 2018, since abandoned. The aforementioned patent applications are herein incorporated by reference in their entirety, including without limitation, the specification, claims, and abstract, as well as any figures, tables, appendices, or drawings thereof.

FIELD OF THE INVENTION

The present disclosure relates generally to the use of collapsible, rotatable, hideable, and/or concealable grab bars. The grab bars may be used, for example, with walk-in bathtubs or showers, in combination with seating or furniture, or even in at least boating, airline, fitness, and home appliance industries.

BACKGROUND OF THE INVENTION

It can be difficult for many to get in and out of a regular height bathtub, and even harder for the elderly and those with disabilities. For some people, it is simply impossible. Wet slippery surfaces and high walls can and do cause accidents and injuries. In fact, statistics show that most accidents in the home occur in the bathroom.

Walk-in bathtubs and showers provide environments that attempt to alleviate the issues of getting in and out of regular bathtubs. A user can simply step over the low threshold, onto the slip resistant floor of the tub, shut the door, sit down on the comfortable chair height seat, and fill the bathtub with calming water.

Furthermore, to aid in entering, exiting, or using the bathtub or shower, grab bars may be included and strategically placed in or around the bathtub or shower. These grab bars, which can be one or a plurality of bars, can be angled or otherwise oriented to provide the user with ease of sitting or standing with the least amount of effort. This is also true for entering and exiting of the tub, as the grab bars can provide a surface for stabilization.

However, as the bars extend from a surface of the bathtub or shower, they can create obstacles or obstructions when not in use. The bars extend away from the bathtub or shower surface and can injure a user if a fall or slip were to occur.

Therefore, there is a need in the art for a grab bar that can be selectively provided for use when needed, but that can be moved to a non-use position in which the grab bar is out of a user's way.

SUMMARY OF THE INVENTION

Therefore, it is a primary object, feature, or advantage of the present invention to improve on or overcome the deficiencies in the art.

It is still yet a further object, feature, or advantage of the present invention to provide a grab bar that can be locked into place during use or when the grab bar is in the non-use position, thereby preventing injury to a user.

It is still yet a further object, feature, or advantage of the present invention to provide a grab bar that is cost effective.

It is still yet a further object, feature, or advantage of the present invention to provide a grab bar that is reliable and durable and has a long usable life.

It is still yet a further object, feature, or advantage of the present invention to provide a grab bar that is easily manufactured, assembled, installed, disassembled, and uninstalled.

It is still yet a further object, feature, or advantage of the present invention to provide an apparatus that is aesthetically pleasing.

It is still yet a further object, feature, or advantage of the present invention to incorporate the grab bar into a system which includes a walk-in bathtub and/or a shower.

It is still yet a further object, feature, or advantage of the present invention to provide methods of using, manufacturing, and installing a grab bar accomplishing some or all of the previously stated objectives.

The present disclosure is directed generally towards one or more grab bars for use with walk-in bathtubs and/or showers. The bathtubs and/or showers may be referred to as a bathing environment of the walk-in sort. A walk-in bathing environment is used by people who may have trouble getting in and out of standard bathtubs or showers. Therefore, the bathing environments of the walk-in sort may include a door or other threshold in which a user does not need to step over in order to enter the tub or other environment.

Grab bars are positioned in and around the bathing environments to aid in entering the environments, exiting the environments, sitting, standing, and otherwise moving relative to the bathing environment. The grab bars may be placed on the walls, top, external, or generally on and around the bathing environment such that a user can grab the one or more grab bars in order to provide support for moving relative to the bathing environment.

The present disclosure contemplates the use of a collapsible type grab bar or a plurality of collapsible type grab bars for use with a walk-in bathing environment. The collapsible grab bars may take many forms, including but not limited to, sliding grab bars, folding grab bars, or the like. Sliding grab bars are movable to extend in and out of a grab bar housing in a manner such that the grab bars move between a useable and non-use configuration. When in a use configuration, the grab bars extend generally away from the housing such that a user is able to grab a portion of the bar to provide support, such as for standing up from a seat of the bathing environment or for entering or exiting through a door of the bathing environment. In a non-use configuration, the bar may be slid such that a majority or substantial portion of the bar is at or below the top threshold of the grab bar housing such that the grab bar is hidden away. In such a configuration, the grab bar will not extend to an area within or outside of the walk-in bathing environment to aid in mitigating the amount of surfaces for getting in the way of a user of the bathing environment.

Other varieties of grab bars include folding type grab bars wherein the grab bar is foldable between a use and a non-use configuration. The grab bar can be rotated about the grab bar housing generally between a 90° angle of movement to place the grab bar in a use or non-use configuration. For example, in a non-use configuration, the grab bar can be housed substantially within a recess of the grab bar housing such that it does not extend outwardly therefrom. However, in a use configuration, the grab bar can be rotated and locked in place such that it is rotated approximately 90° from the non-use configuration to allow a use to be able to grab a bar and use said bar in moving relative to the bathing environment. For example, when a user is done with their bathing and wishes to exit the bathing environment, they may fold down one or more grab bars such that the user can pull himself or herself up and provide a more stabilized surface for exiting the bathing environment.

Therefore, according to some aspects of the present invention, a grab bar assembly comprises a grab bar housing including a recessed portion and a flange portion, and a rotatable grab bar comprising a handle portion, a leg portion, and a central pivot pin, the rotatable grab bar being rotatable around the central pivot pin between a use configuration and a non-use configuration. The handle portion extends outwardly from the flange portion when in the use configuration. The rotatable grab bar is at least partially within the recessed portion in the non-use configuration.

According to some additional aspects of the present invention, the central pivot pin passes through a central bar aperture of the leg portion, a centrally located upper aperture in the recessed portion, and a centrally located lower aperture in the recessed portion. The central pivot pin is housed within a bridge portion centrally located in the leg portion. An end of the central pivot pin is male-threaded and the centrally located lower aperture is female-threaded. A locking mechanism for resisting or preventing the rotatable grab bar from moving out of the non-use configuration or the use configuration. The locking mechanism comprises a spring and a ball positioned in an aperture of the leg portion. The rotatable grab bar includes a mechanical catch for preventing the rotatable grab bar from rotating more than 180°. The recessed portion includes a notch at each end to receive the mechanical catch when the rotatable grab bar is in the use configuration or the non-use configuration.

According to some other aspects of the disclosure, the grab bar assembly is built into a surface. The handle portion of the grab bar is at or below the surface when in the non-use configuration and the rotatable grab bar extends outward at least partially from the surface in the use configuration. The surface is associated with a seat.

According to some other aspects of the present disclosure, a walk-in bathing environment is provided. The walk-in bathing environment includes a housing having an entrance for providing access to an interior of the housing. A door may be positioned at the entrance for selectively allowing entrance and for aiding in holding an amount of water therein. One or more grab bars can be operatively connected to the housing, with the grab bars being rotatable around a central pivot pin between a use configuration and a non-use configuration.

The preceding provides a list of aspects or embodiments disclosed herein and does not limit the overall disclosure. It is contemplated that any of the embodiments disclosed herein can be combined with other embodiments, either in full or partially, as would be understood from reading the disclosure. These or other objects, features, and advantages of the present invention will be apparent to those skilled in the art after reviewing the following detailed description of the illustrated embodiments, accompanied by the attached drawings.

Figure 1:
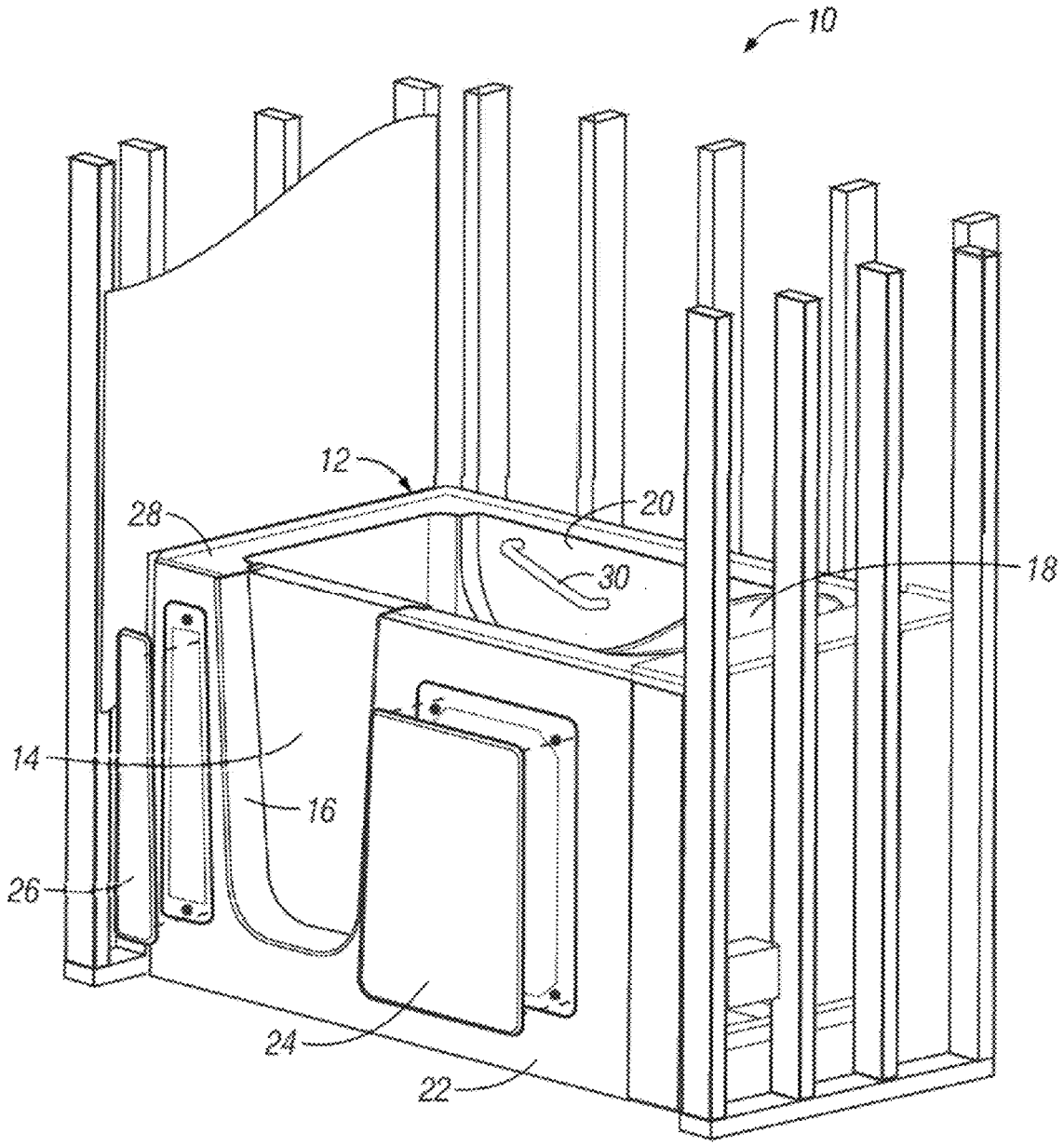
FIG. 1 is a perspective view of a walk-in bathtub.

Various embodiments of the present disclosure illustrate several ways in which the present invention may be practiced. These embodiments will be described in detail with reference to the drawings, wherein like reference numerals represent like parts throughout the several views. Reference to specific embodiments does not limit the scope of the present disclosure and the drawings represented herein are presented for exemplary purposes.

DESCRIPTION OF EXEMPLARY EMBODIMENTS

The following definitions and introductory matters are provided to facilitate an understanding of the present invention. Unless defined otherwise, all technical and scientific terms used herein have the same meaning as commonly understood by one of ordinary skill in the art to which embodiments of the present invention pertain.

The terms "a," "an," and "the" include plural referents unless context clearly indicates otherwise. Similarly, the word "or" is intended to include "and" unless context clearly indicate otherwise. The word "or" means any one member of a particular list and also includes any combination of members of that list.

The terms "invention" or "present invention" as used herein are not intended to refer to any single embodiment of the particular invention but encompass all possible embodiments as described in the specification and the claims.

Terms such as first, second, vertical, horizontal, top, bottom, upper, lower, front, rear, end, sides, concave, convex, and the like, are referenced according to the views presented. These terms are used only for purposes of description and are not limiting unless these terms are expressly included in the claims. Orientation of an object or a combination of objects may change without departing from the scope of the invention.

The following embodiments are described in sufficient detail to enable those skilled in the art to practice the invention however other embodiments may be utilized. Mechanical, procedural, and other changes may be made without departing from the spirit and scope of the invention. Accordingly, the scope of the invention is defined only by the appended claims, along with the full scope of equivalents to which such claims are entitled.

FIG. 1 shows a perspective view of a bathing environment 10, which is shown to be a walk-in type bathtub. While a bathtub is shown as the bathing environment 10, it should be appreciated that other types of bathing environments, including other types of bathtubs, showers, saunas, or other environments are included to be used with the aspects of the invention. The walk-in bathtub 10 includes a housing 12. The housing 12 comprises a fiberglass shell that is made of sheets of fiberglass lying on top of one another and finished with a gel coating. An entrance 16 is formed within the housing 12 and is closed off or accessed by a door 14 positioned at the entrance. The door 14 also comprises a fiberglass material and is hingeably attached to the housing 12 at the entrance 16 such that it is open and closable. The door 14 will include a seal (not shown) to ensure that water added to the interior of the housing 12 does not leak or otherwise disperse through the entrance 16 when the door is closed, such as shown in FIG. 1. Further aspects of the housing 12 include an interior wall 20 and an exterior wall 22, and a bathtub top surface 28 extending generally between the interior 20 and exterior 22 walls. As shown in the figure, access panels 24, 26 may be included on the external or internal walls to provide access to the interior of the housing walls such that pipes, electronics, or other internal components of the bathtub 10 can be accessed. Still other components such as jets, control panels, user interfaces, faucets, showerheads, curtains, and the like may be included with the bathing environments.

Figure 2:
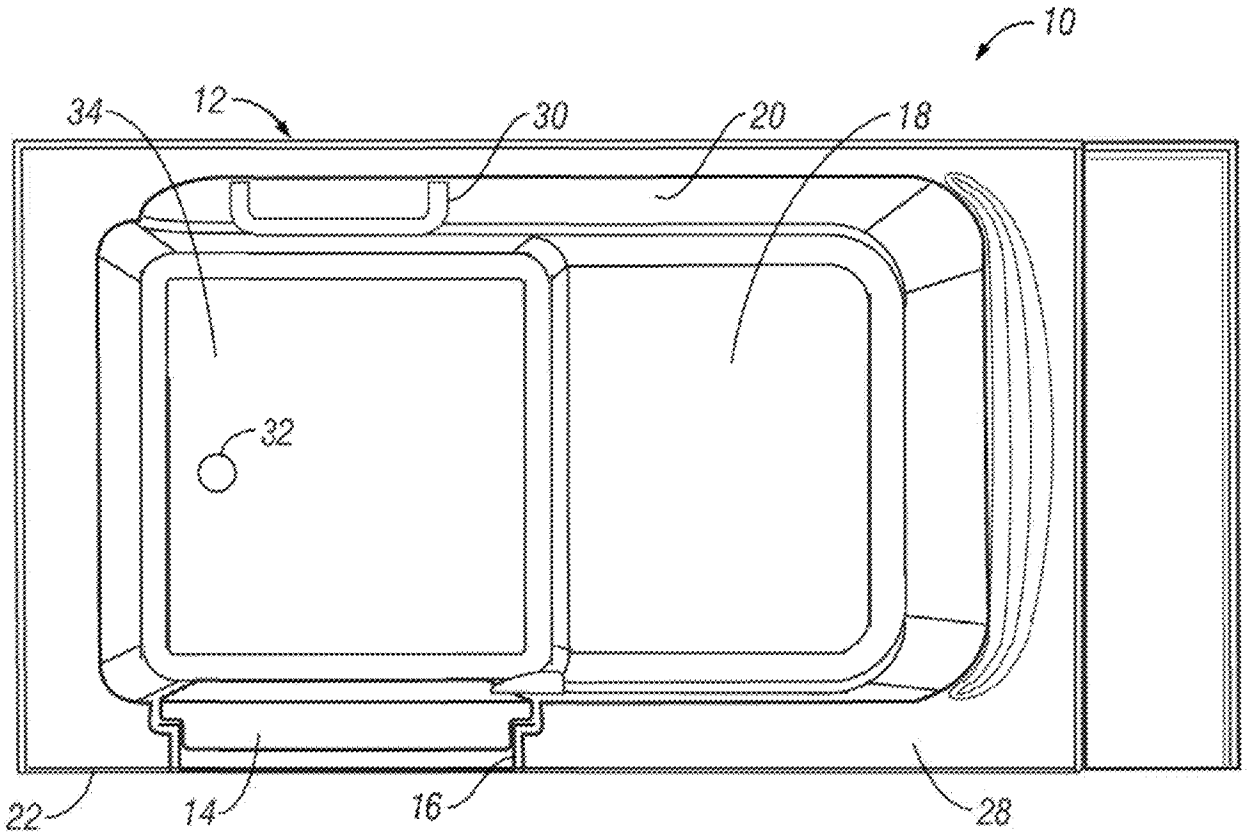
FIG. 2 is a top plan view of a walk-in bathtub.

FIG. 2 shows a generally top planar view of a bathtub as similar to that shown in FIG. 1. The bathtub 10 shown in FIG. 2 includes many of the same components thereof, and includes a view of a top surface 28 generally connecting the interior wall 20 and exterior wall 22 of the housing 12. Additional components shown in FIG. 2 include a seat 18, a drain 32, and a floor 34 of the housing 12. The floor and/or seat may include a non-slip finish such that the finish will mitigate slippage by a user when the bathtub includes water added therein. Additional aspects may include a seat cushion on or around the seat 18 to provide comfort for the user of the bathtub 10. Furthermore, as is shown in FIGS. 1 and 2, a grab bar 30 is included at the interior wall 20 of the housing 12. The grab bar 30 shown in the figures is a substantially U-shaped member comprising a rigid material, such as metal, plastic, or the like. The grab bar is angled on the interior wall of the housing 12, to aid in use thereof. For example, the grab bar 30 may be ergonomically angled to provide the user of the bathtub 10 in ease of sitting or standing with the least amount of effort. Furthermore, while it is not shown, additional grab bars can be positioned throughout the interior and/or exterior of the housing 12, such as in or on the interior wall 20, or the bars can be added as well as to the top surface 28 of the bathtub or shower or other bathing environment. Additional grab bars can provide additional stability when entering or exiting the walk-in type bathtub.

FIGS. 3-8 show exemplary aspects of a type of collapsible or movable grab bar 40 that may be used at one or more of the locations of the grab bar in and around a bathing environment 10, such as a walk-in bathtub or shower. It is to be appreciated that the grab bar assembly 40 shown in the figures can be used throughout the bathing environment 10, or could just be used selectively in certain places. For example, the grab bar 40 shown in the figures may be used on the top wall of a bathtub and/or shower, while other types of grab bars, such as other types of collapsible or movable bars, or even fixed and rigid grab bars may be utilized, e.g., the angled grab bar. However, the present disclosure is not to be limited to the use of only one type of grab bar at the locations, and is contemplated that any combination or use of any of the type grab bars herein disclosed can be used at any location on and around a bathing environment.

The grab bar assembly 40 shown in FIGS. 3-8 is a movable grab bar assembly that includes a bar 44 that is slidable relative to a housing 42 to provide a grab bar that can be positioned in a use and non-use configuration. The grab bar assembly 40 includes a housing 42 which includes a recessed portion 43 and a flange portion 47. The recessed portion 43 can fit within the flange portion 47 of the housing 42 and can be integrally formed there a part of, or can be a separate piece that is combined with the flange portion of the housing 42. The recessed portion 43, which may also be a seat portion 43, includes a first aperture 50 and a second aperture 52 therethrough. The flanged portion 47 of the housing 42 and the recessed portion 43 can comprise generally any rigid or semi-rigid material, including but not limited to, a metal material, a ceramic material, a plastic material, a rubber material, composite material, or some combination thereof. The components are shown to be elongated with the recessed portion 43 being a generally oval type shape that is nestled within an aperture 45 of the housing 42. Thus, according to some aspects of the invention, the housing 42 may be positioned with the recessed portion 43 nestled into and adhered to the housing 42 such that the recessed portion 43 and housing 42 include a water tight bond and/or seal therebetween. The housing component 42 and recessed portion 43 can then be positioned through or in an aperture of the housing 12 of the bathing environment 10. For example, an aperture can be positioned on the top wall 28 of the housing 12 of the bathing environment 10, with the housing of the grab bar 40 positioned therein in a water tight and sealed configuration.

A bar 44 is included with the grab bar assembly 40 shown in the figures. The bar 44 includes a substantially elongated midsection with first and second legs 46, 48 extending therefrom. For example, as is shown in the figures, the legs 46, 48 extend in a downward manner from the centralized elongated tubing of the bar 44. The bar 44 is shown to be formed from a substantially circular tube formed in a generally U-shaped configuration, but it is to be appreciated that generally any shape or configuration of a grab bar may be included. Furthermore, the bar 44 can comprise generally any rigid material, including but not limited to, steel or other metals, plastic, rubber, composites, or the like. Furthermore, if a steel tubing is used to form the bar 44, a rubber or other non-slick material or coating may be added to portions of the bar 44 to provide additional comfort and grip for use of the bar by an individual. Additional aspects and/or variations may include bends or recessed portions in or on the elongated portion of the bar 44, in which said portions aid in the grip of the bar during use thereof. Said bends or recessed portions can be formed to coincide with a grip of the bar to provide greater support of the bar.

Figure 3:
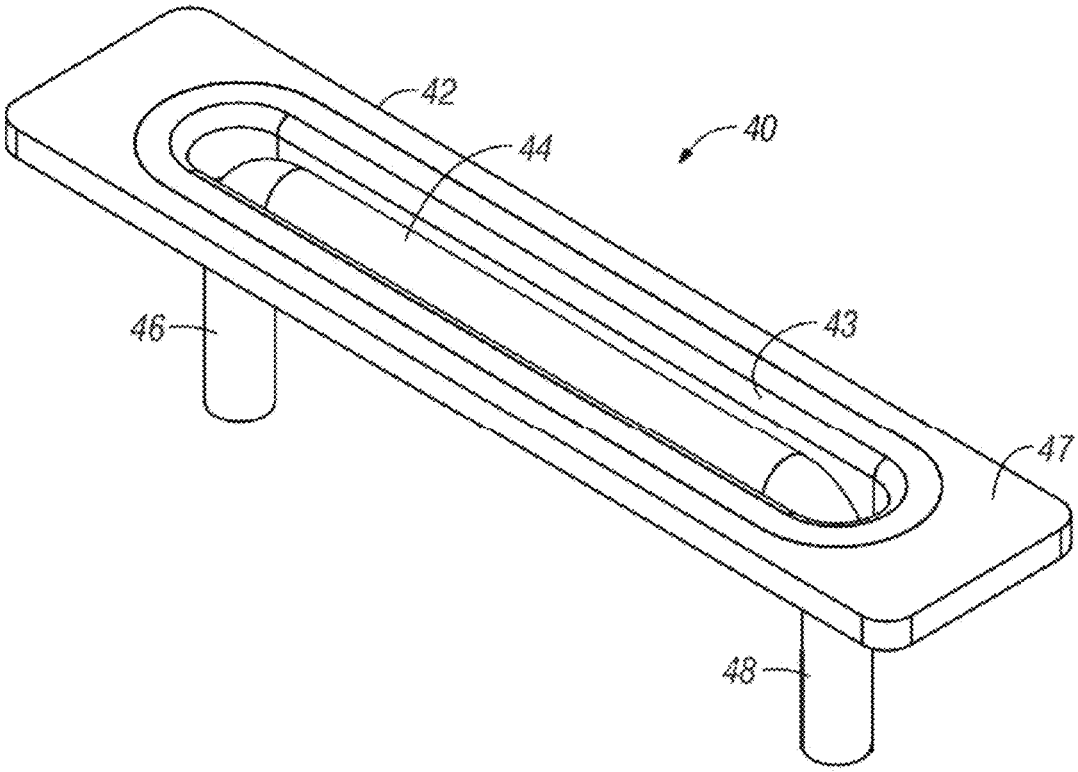
FIG. 3 is a perspective view of a grab bar in a non-use configuration according to some aspects of the invention.
Figure 4:
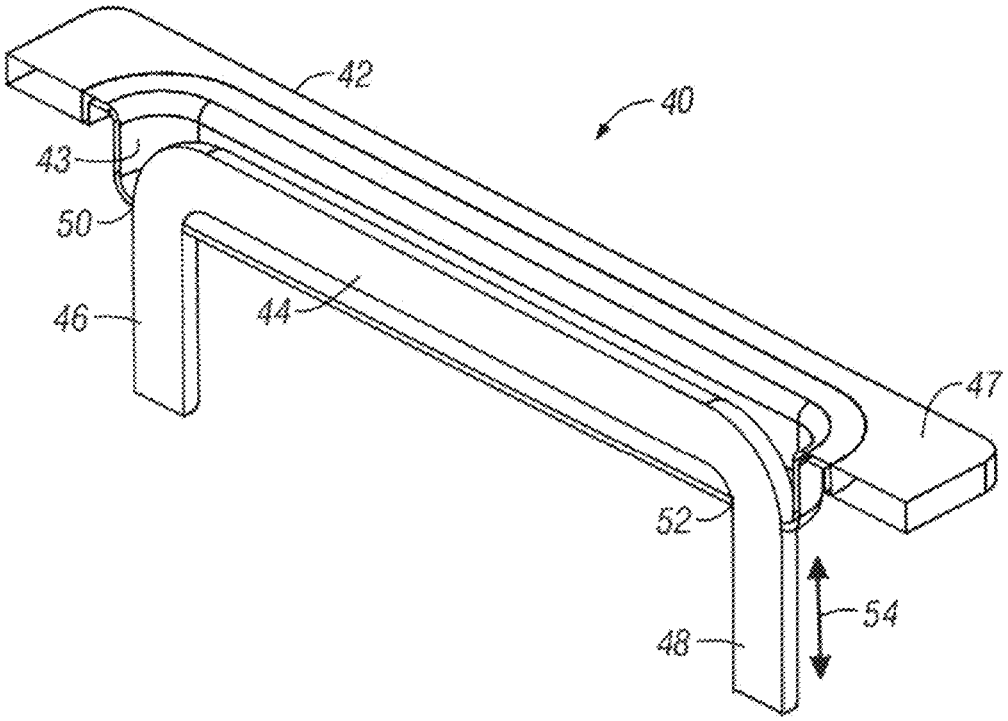
FIG. 4 is a sectional view of the grab bar of FIG. 3.

The bar 44 is positioned with the grab bar assembly such that the first leg 46 is inserted into the first aperture 50 of the recess 43, and the second leg 48 being positioned generally within the second aperture 52 of the recessed portion 43. As shown in FIG. 3, the bar can be lowered or otherwise moved such that the elongated portion of the bar 44 is housed substantially within the recessed portion 43 of the housing 42. This can be known as a non-use configuration of the grab bar assembly 40, wherein the bar will not be used or intended to be used by an individual. The bar being substantially within the recessed portion provides that the bar not be an obstruction or otherwise extend into a portion of the bathing environment 10. The bar can be maintained in this position in a variety of ways. For example, it is contemplated that the bar include a coating, ring, cover, or otherwise be sized such that the bar is friction fit within the apertures 50, 52 of the recessed portion 43 to hold the bar in place in the non-use configuration, as is shown in FIGS. 3 and 4. O-rings or other members could surround the legs such that, when in contact in the apertures 50, 52 of the housing, the bar will be held in place. Furthermore, inserts can be inserted into the apertures 50, 52 to further increase the friction therein to hold the bars in place in the non-use configuration. Other types or devices may be utilized to hold the bar in place, such as snaps, hooks, latches, spring members, or the like.

Figure 5:
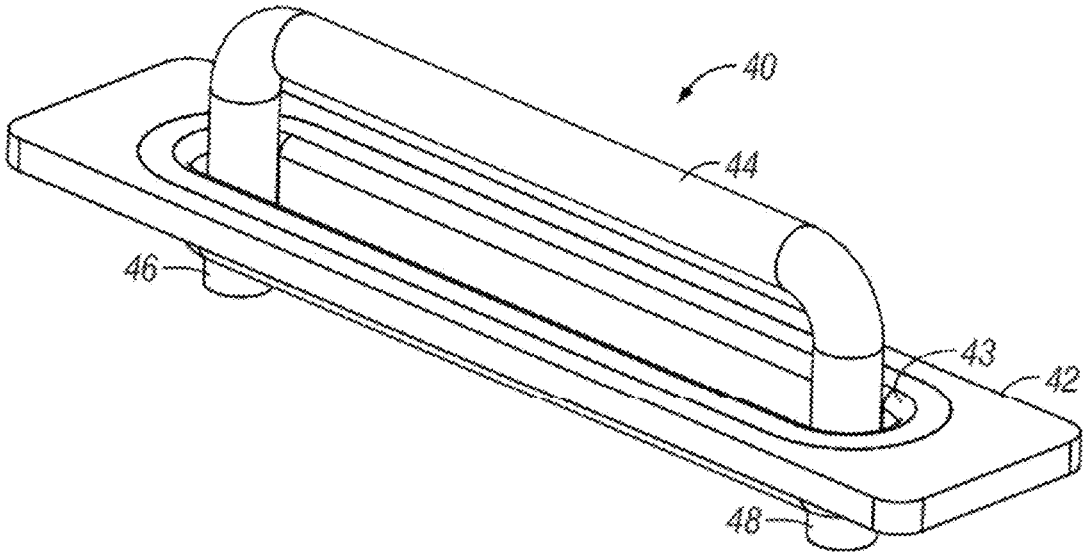
FIG. 5 is a perspective view of the grab bar of FIG. 3 in a use configuration.
Figure 6:
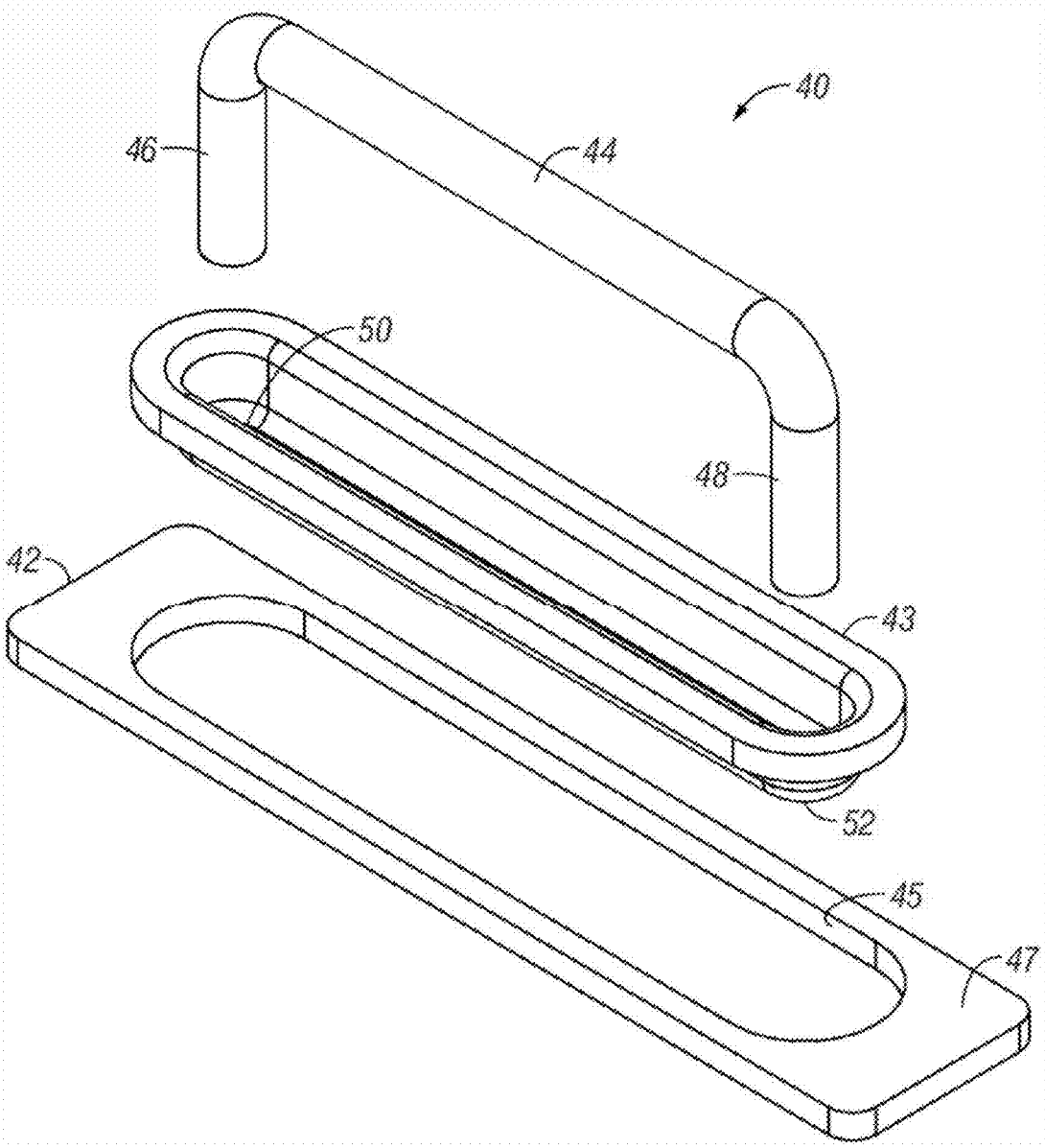
FIG. 6 is a perspective exploded view of the grab bar of FIG. 5.
Figure 7:
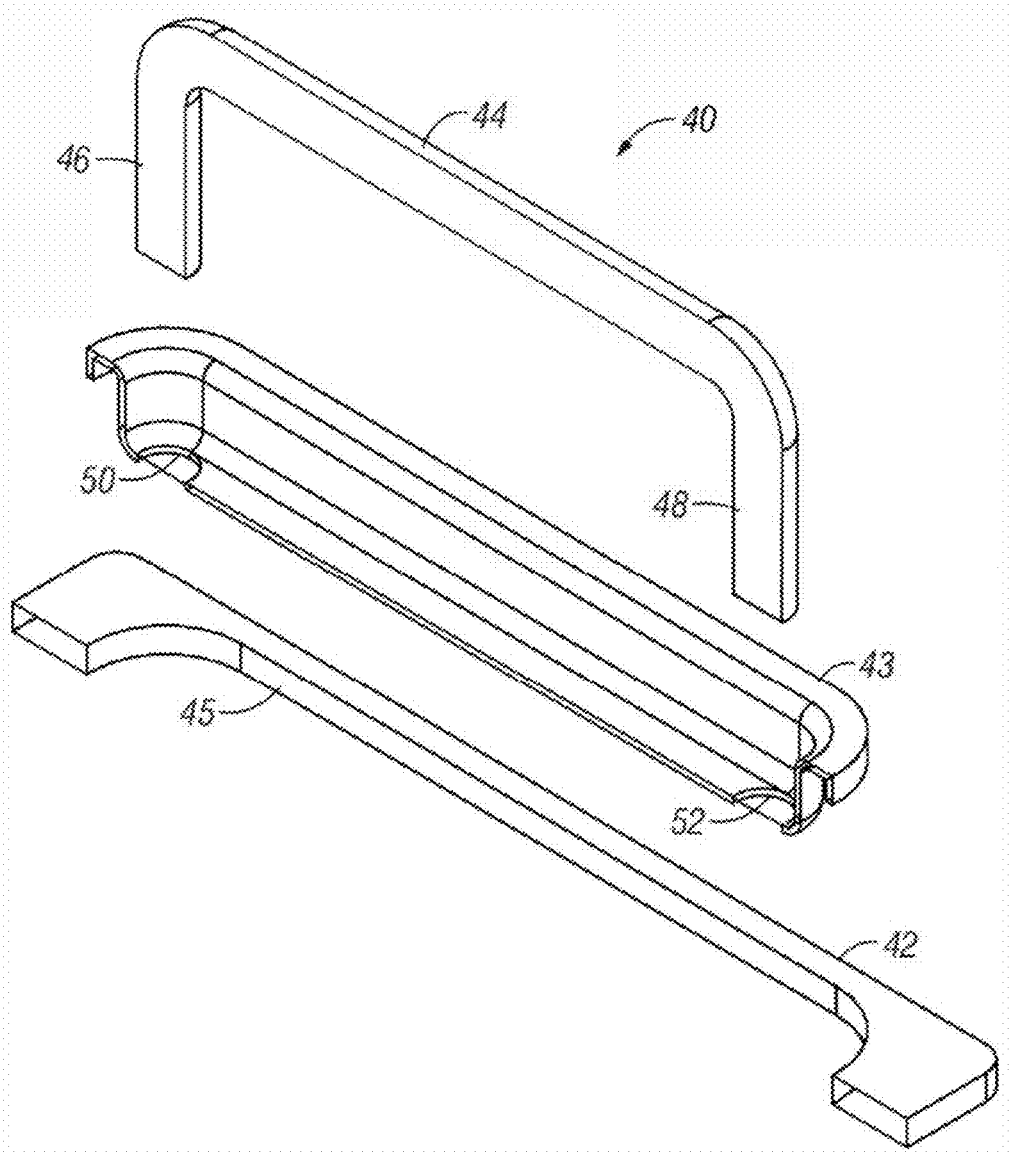
FIG. 7 is a sectional exploded view similar to FIG. 6.
Figure 8:
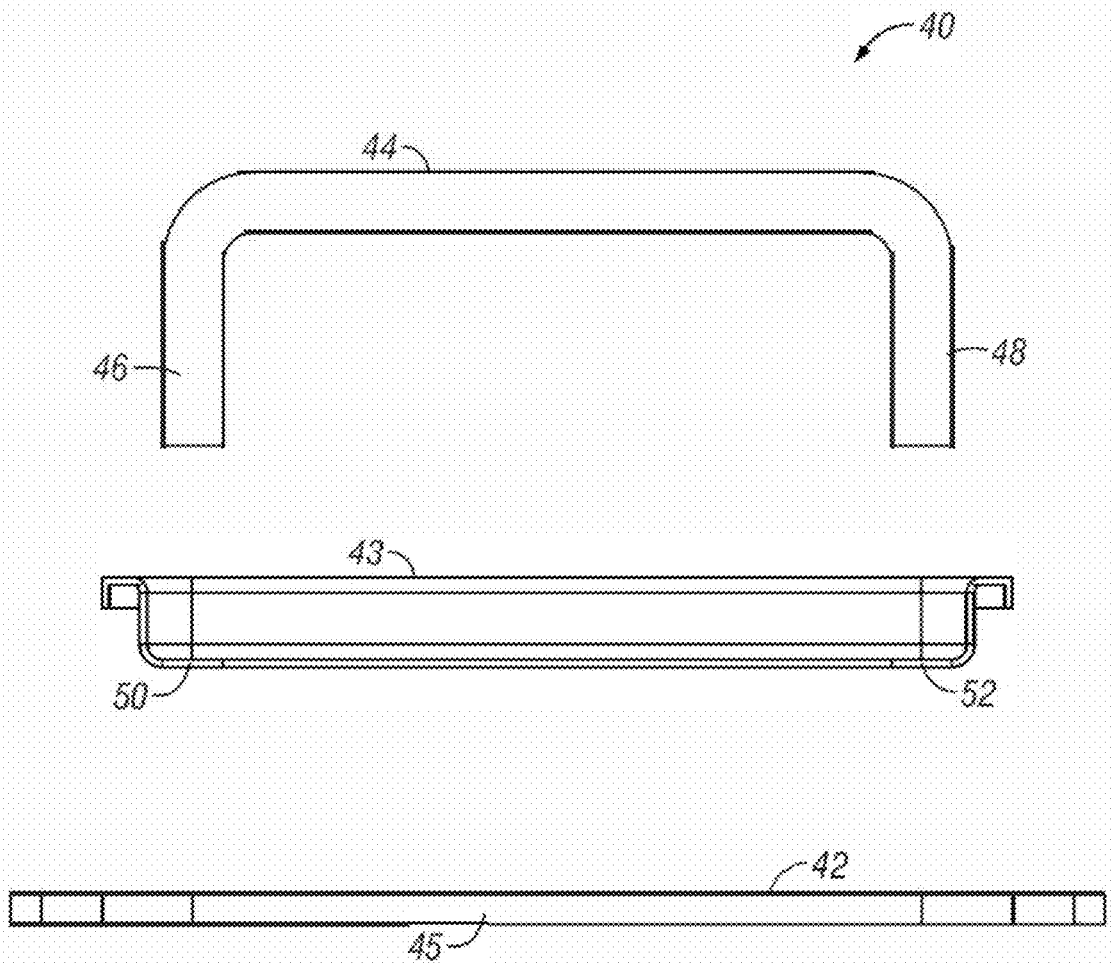
FIG. 8 is a front plan view of the grab bar of FIG. 7.

When a user needs to use a grab bar 40 of the like shown in FIGS. 3-8, the bar can be moved from the non-use configuration, such as that shown in FIG. 3, to a use configuration, such as that shown in FIG. 5. Moving the bar in the direction of the arrow 54 away from the housing 42 as shown in FIG. 4 will move the bar from a non-use to a use configuration. For example, the bar 44 can be slid, pulled, or otherwise moved in an upward manner to slide the legs 46, 48 of the bar 44 relative to the apertures 50, 52 of the housing 42. The sliding of the bar 44 in a manner as described will extend the bar away from the housing 42 of the grab bars 40 to allow a user to be able to grab and/or interact with the grab bar 44. Thus, the bar can be moved a distance such that a user can grab at least a portion of the elongated portion of the bar 44 with a hand. Therefore, the distance may be such that a hand or a portion thereof is able to come between a portion of the elongated section of the bar 44 and the housing 42.

The bar can be maintained in the use configuration such that a user is able to utilize the bar. For example, the bar can be friction fit such that when extended outwardly a set distance, a portion of the leg of the bar 44 can include a surface that will become friction fit within the apertures 50, 52 of the recessed portion 43. Furthermore, a spring loaded member can be included with one or more of the legs 46, 48 to extend once passed through the apertures 50, 52 in order to maintain the bar in a use configuration wherein it is extended away from the housing 42.

Furthermore, it is contemplated that the bar can be operated with the use of actuators or other members. An actuator, for example a linear actuator, pneumatic actuator, or the like, can be activated via an electronic connection between a button and power source to extend a rod of the actuator, which can be connected to one or more of the legs of the bar 44. The extension of the actuator will extend the bar out from the non-use configuration to the use configuration and will maintain the bar at the distance set by the extension. When the bar is to be moved to a non-use configuration, activation of the actuator can withdraw the rod of the actuator, which will move the bar 44 towards the housing end back into the recess thereof. Therefore, it is to be appreciated that the collapsible grab bar assembly 40 as shown can be utilized can moved in many ways, and is not to be limited to the configuration shown in the figures.

FIGS. 9-13 show a grab bar assembly 60 including additional aspects of the invention. While the grab bar assembly 40 included a bar that can be described as being slid relative a housing to move the bar between a use and a non-use configuration, the grab bar assembly 60 as shown in FIGS. 9-13 includes a collapsible grab bar assembly in which a bar 72 is rotated relative a housing 62 to move said bar 72 between the use and non-use configurations.

Figure 9:
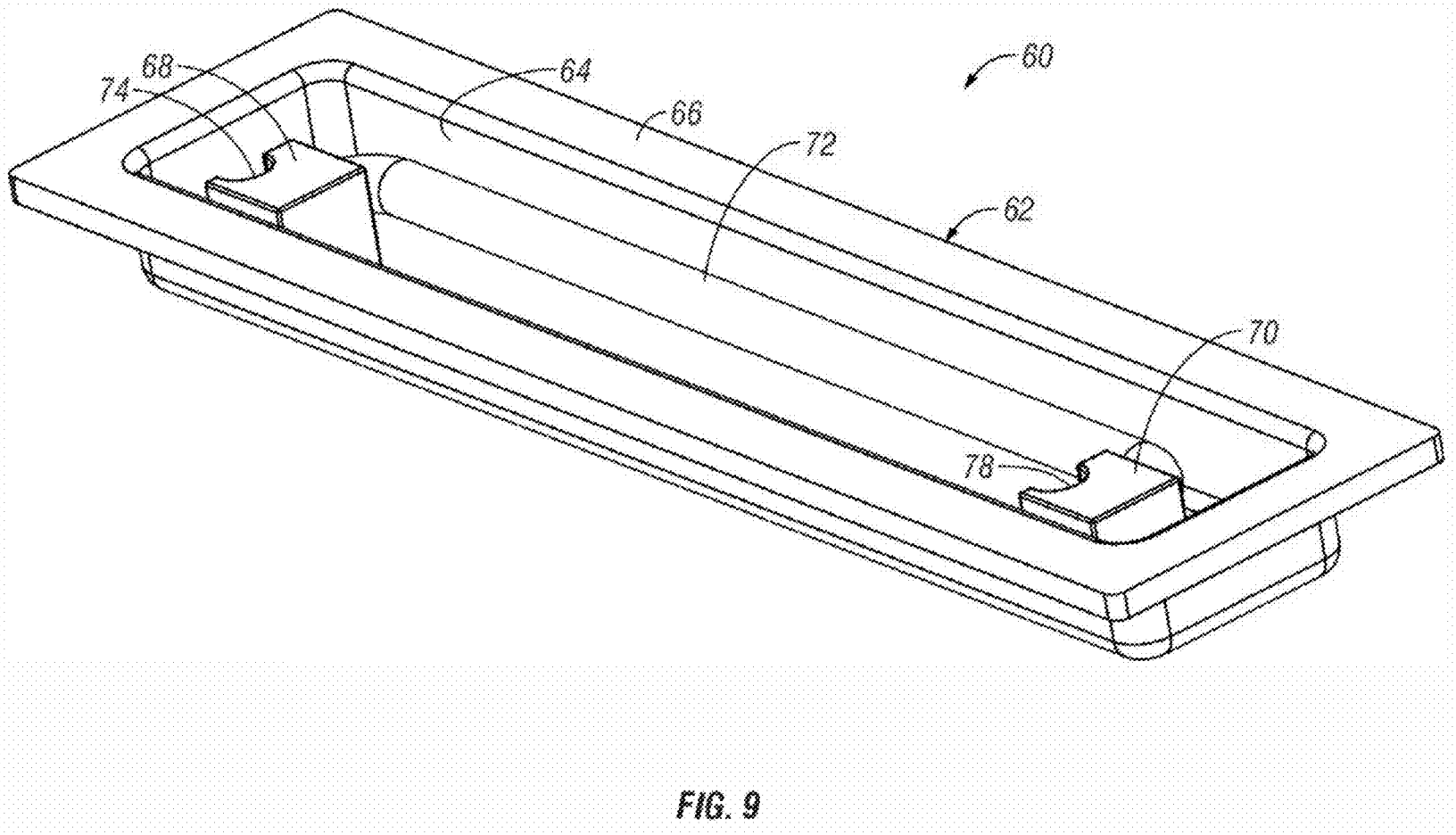
FIG. 9 is a perspective view of a grab bar in a non-use configuration according to additional aspects of the invention.
Figure 10:
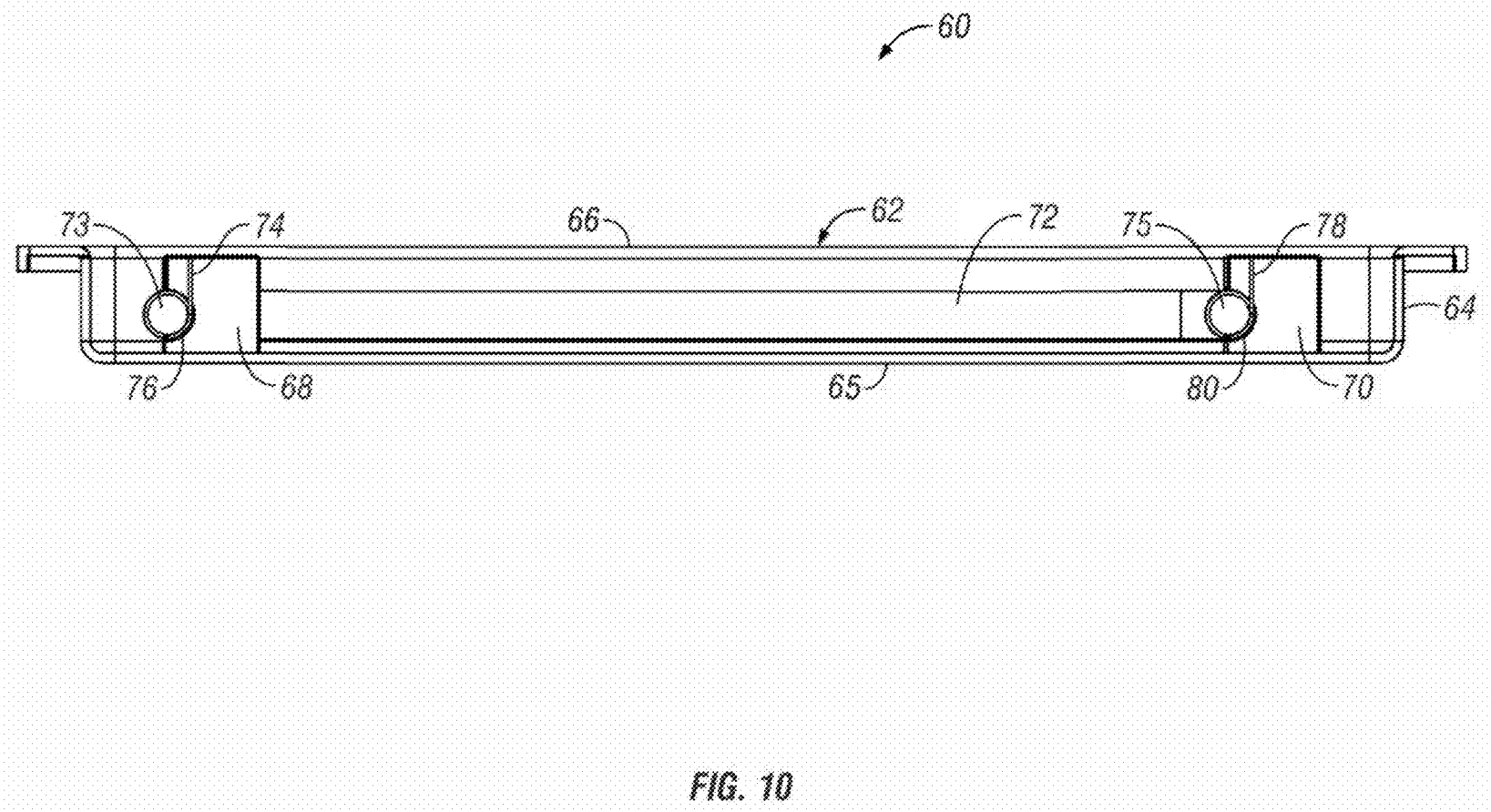
FIG. 10 is a front sectional view of the grab bar of FIG. 9.

FIGS. 9 and 10 show the grab bar assembly 60 with a bar 72 in a substantially non-use configuration. The bar 72 is positioned such that it is substantially within a recessed portion 64 of the housing 62, and therefore will not substantially extend outward of the recessed portion beyond a flange portion 66 of said housing 62. The housing 62 includes a recessed portion 64 generally extending away from the outwardly extending flange portion 66. The housing 62 can comprise generally any rigid or substantially rigid material, including, but not limited to ceramics, Plexiglas, fiberglass, metals, plastic, composites, rubber, or some combination thereof. Furthermore, the recessed portion 64 and flange 66 can comprise a single, integrally manufactured component, or can comprise separate pieces that are then attached to one another. In addition, a first and second block member 68, 70 is included in the recessed portion 64 and positioned on or at a floor 65 of the housing 62. The first and second blocks 68, 70 can comprise a substantially rigid material as has been described, and are shown to be components with groove members. For example, the first block 68 includes a first vertical groove 74 and a first horizontal groove 76. The second block 70 includes a second vertical groove 78 and a second horizontal groove 80. According to some aspects of the invention, the blocks will be generally or substantially identical to one another, including the position and size of the grooves.

The bar 72 for use with the grab bar assembly 60 is similar to that previously disclosed in that it is a substantially U-shaped member including an elongated portion and first and second legs 73, 75 extending generally therefrom. The elongated portion may be substantially horizontal with the legs extending at generally 90° therefrom. However, additional configurations of the bar may be included and considered part of the present disclosure. The bar 72 also should be comprised a substantially circular tube member, but it is to be appreciated to comprise any shape, composition, and/or size.

As shown in the figures, the bar 72 is positionable in and communicable with the grooves of the first and second blocks 68, 70. For example, as shown in FIGS. 9 and 10, the legs 73, 75 of the bar 72 are positioned generally within the horizontal grooves 76, 80 of the blocks. In such a configuration, the bar 72 is in a non-use configuration with the elongated portion of the bar 72 below or substantially below the flange 66 of the housing 62. However, it is to be appreciated that any portion of the bar may extend beyond the flange in some embodiments, as the grooves may not necessarily be horizontal or vertical, and instead, be at some angle therebetween. The shape and size of the grooves of the blocks can communicate with the shape and size of the legs of the bar 72 to hold the bar 72 in place in the non-use configuration. The grooves need not be the same size, arc, shape, or otherwise to mate exactly with the bar, and instead, can be of any shape or type to communicate with the portions of the bar. For example, as is shown best in FIG. 10, the grooves being cut into the block will provide a lip that at least partially envelopes the bar legs 73, 75 to hold the bar in the manner wherein it is shown to be on its side within the recessed portion 64 of the housing 62. However, when the bar 72 is to be used, it can be rotated relative to the blocks 68, 70 to a use configuration.

Figure 11:
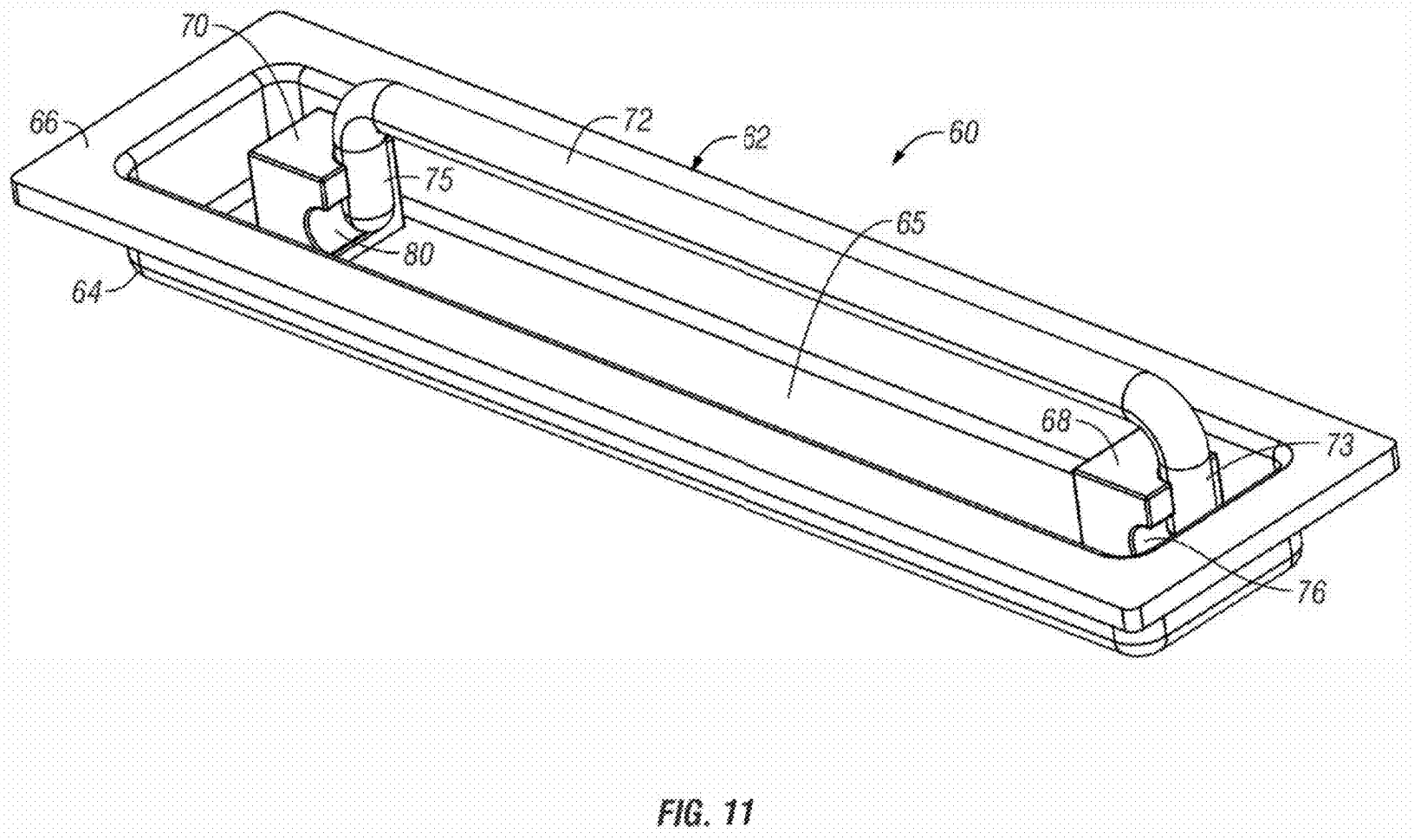
FIG. 11 is a perspective view of the grab bar of FIG. 9 in a use configuration.
Figure 12:
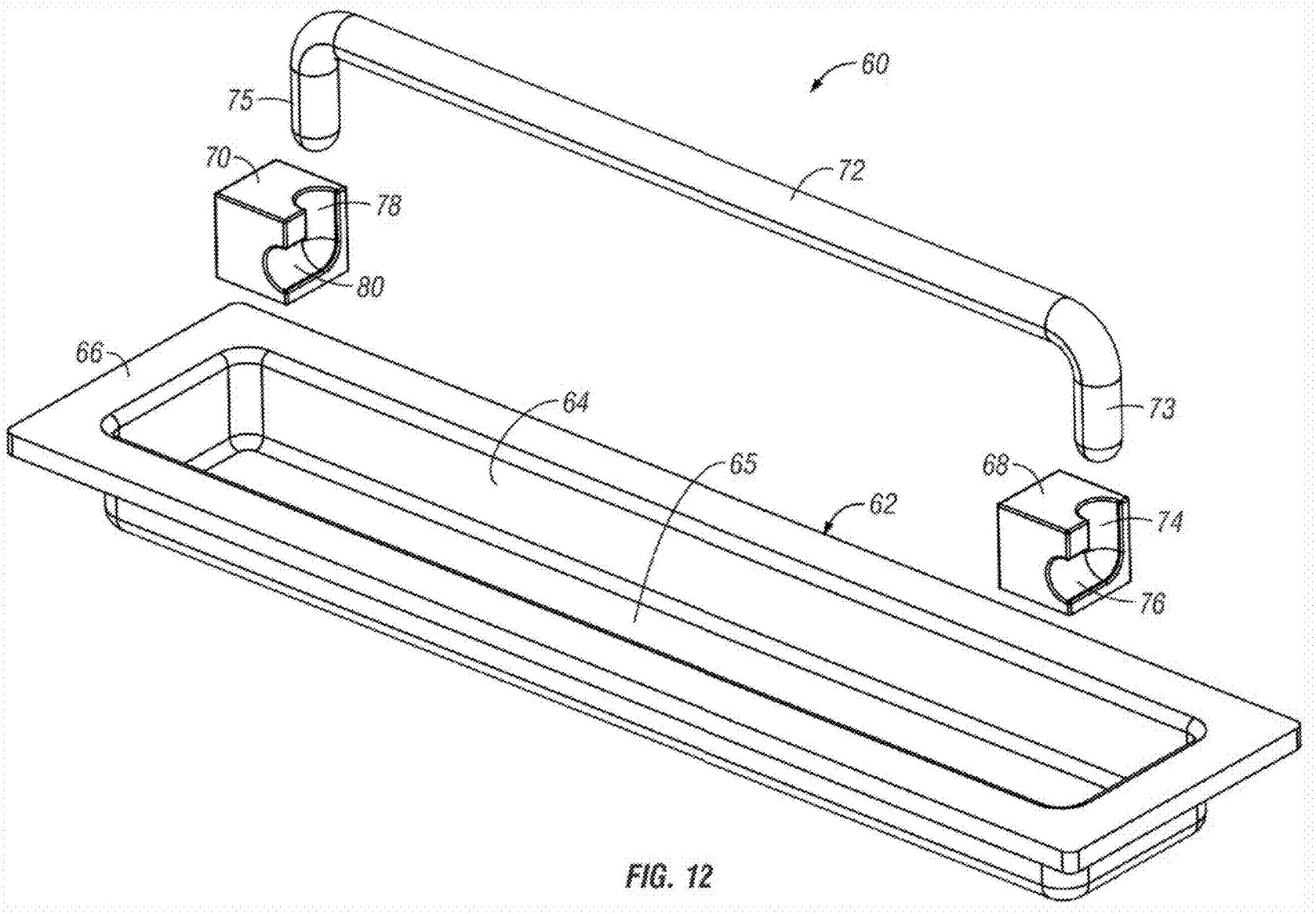
FIG. 12 is a perspective exploded view of the grab bar of FIG. 11.
Figure 13:
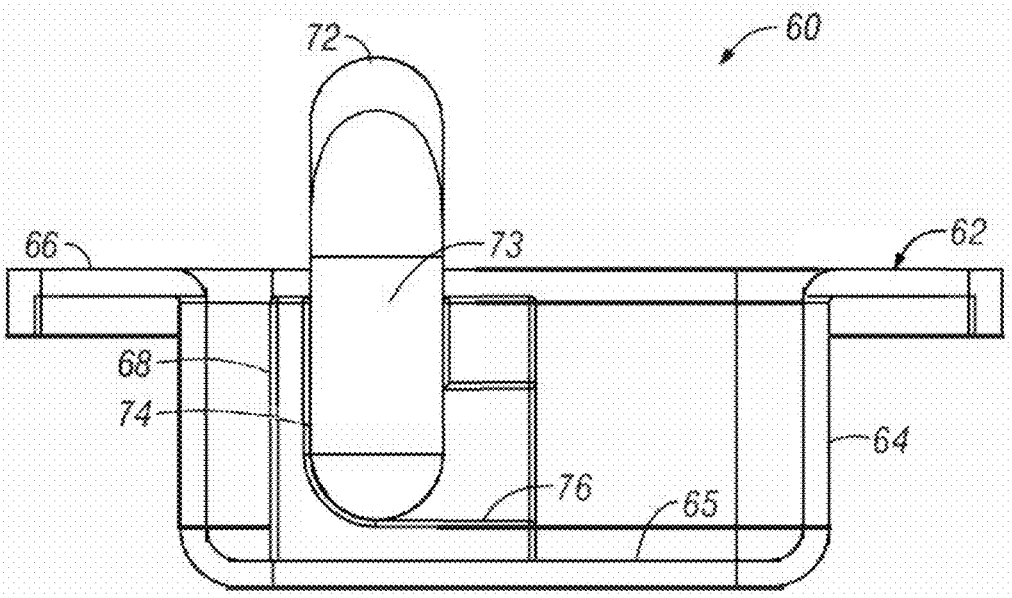
FIG. 13 is a sectional view showing aspects of the grab bar of FIG. 11.
Figure 14:
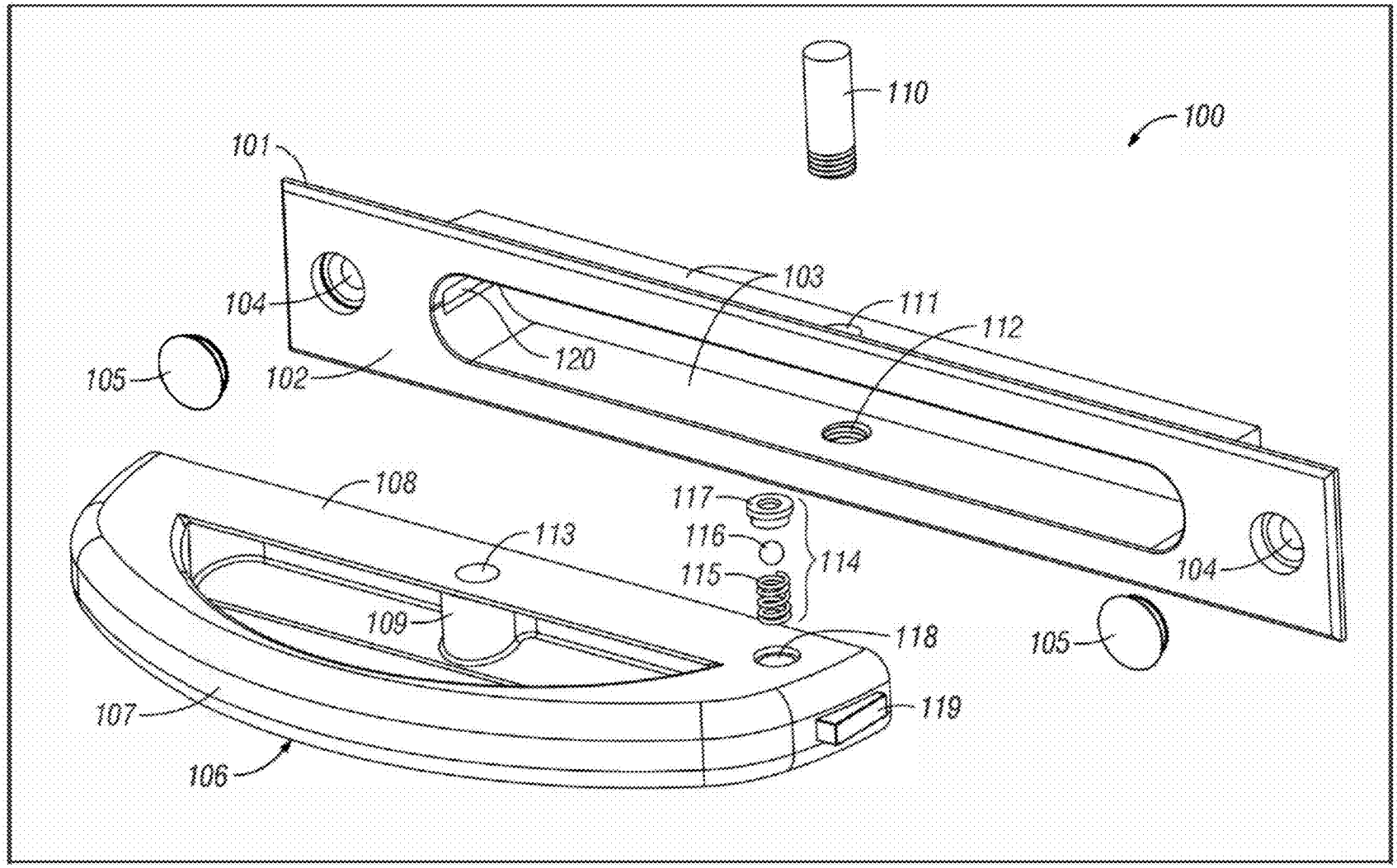
FIG. 14 is an exploded view of a grab bar according to additional aspects of the disclosure.
Figure 15:
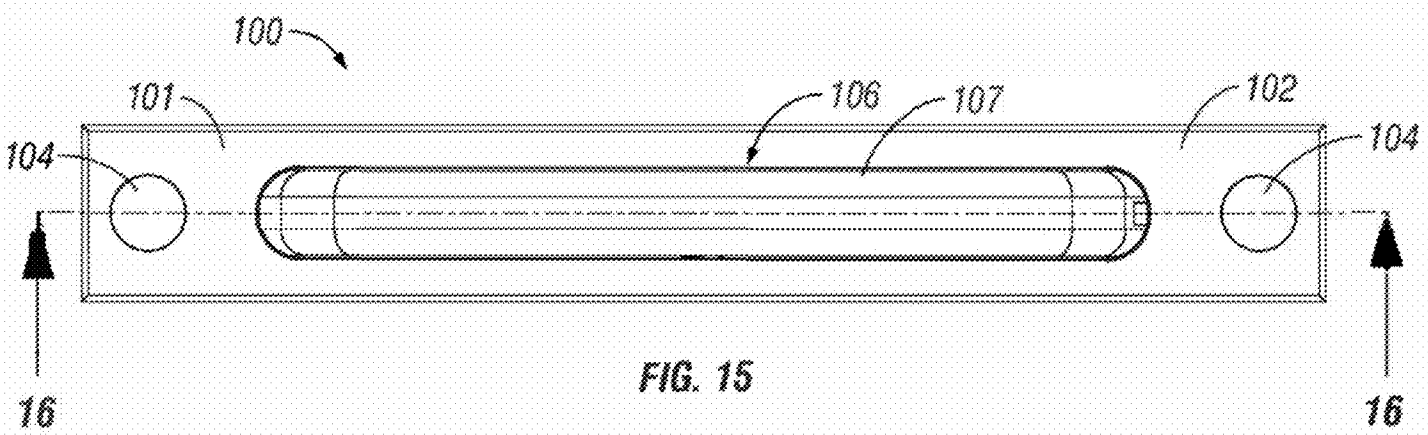
FIG. 15 is a front elevation view of the grab bar of FIG. 14.
Figure 16:
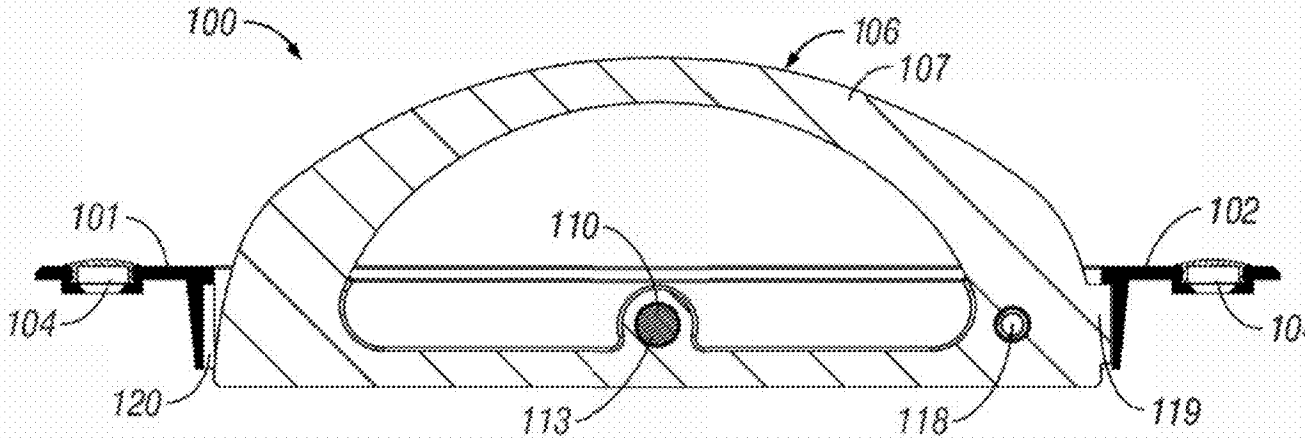
FIG. 16 is a side plan view of the grab bar of FIG. 14.
Figure 17:
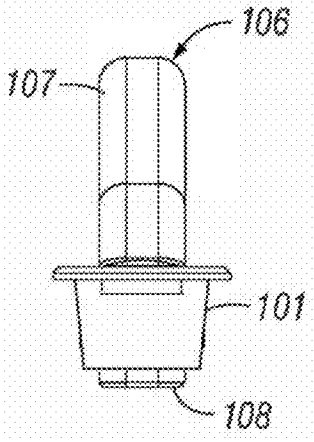
FIG. 17 is a side elevation view of the grab bar of FIG. 14.

As shown in FIGS. 11-13, the bar has been rotated relative to the grooves of the blocks to move from a generally non-use configuration to a use configuration. The grooves of the blocks are shown to be substantially 90° relative to one another. For example, as shown with the first block 68, the vertical groove 74 is substantially 90° from the horizontal groove 76. This provides two extremes for the exemplary case for the bar 72 to move and to be held in place. For example, when the bar is rotated to position the legs 73, 75 and the vertical grooves 74, 78 of the block 68, 70, the bar will extend generally 90° relative to the floor 65 of the housing 62 wherein the elongated portion of the bar 72 will be extending outwardly of the housing 62 such that a user is able to grasp and use the bars for stabilization or other movement. The grooves in the blocks will aid in holding the bar 72 in the use configuration as shown in the figures such that a user can have confidence that the bar will not collapse during use of said bar. As has been noted, while the grooves may be positioned at 90° angles from one another, other angles, limits, extremes, etc., may be included, as well as additional grooves to be able to hold the bar in place somewhere between the outer extremes. It is to be appreciated that modifications can be made to hold the bar at generally any angle or location to be best used by a user.

Therefore, the lip of the grooves may be slight enough to be overcome with some force to move the bar from the horizontal position to the vertical position. Furthermore, the bar may be slid in the direction of the elongated section of the bar 72 to move the bar generally from the groove, wherein it can then be rotated and aligned with the next groove and slid back into communication with the second groove in order to be held in place thereat. For example, when the bar 72 is in the non-use configuration and held within the groove 76, 80, the bar may need to be slid away from the grooves in order to move to the use configuration. Thus, the entire bar can be slid such that the legs 73, 75 will have some clearance from the grooves 76, 80, and then the bar 72 can then be rotated towards the vertical groove 74, 78. Once generally aligned with the vertical groove 74, 78, the bar can be slid into communication therewith, wherein the bar will be held therein at a use configuration. Additional means and methods of moving the bar between the non-use and use configuration and holding thereat are considered to be included as part of the present disclosure.

FIGS. 14-17. 18A-18C, 19A-19C, and 20A-20C show a grab bar assembly 100 including additional aspects of the invention. While the bar 72 of the grab bar assembly 60 can be described as being rotated relative to relative to grooves of the blocks 68, 70 of the housing 62 to move said bar 72 between the use and non-use configurations, the grab bar assembly 100 as shown in FIGS. 14-17, 18A-18C, 19A-19C, and 20A-20C includes a collapsible grab bar assembly 100 in which a rotatable grab bar 106 is rotated around a central, fixed, and threaded central pivot pin 110 between use and non-use configurations.

FIGS. 14-17 show components of the grab bar assembly 100. The grab bar assembly 100 includes a housing 101 having a flange portion 102, a recessed portion 103, and a housing aperture 121. The recessed portion 103 can fit within the flange portion 102 of the housing 101 and can be integrally formed there a part of or can be a separate piece that is combined with the flange portion 102 of the housing 101. The recessed portion 103, which may also be a seat portion, includes a recessed portion upper aperture 111 and a recessed portion lower aperture 112. The recessed portion lower aperture 112 includes grooves or threads for receiving a threaded pivot pin 110 that the grab bar assembly 100 rotates around. The flanged portion 102 of the housing 101 and the recessed portion 103 can comprise generally any rigid or semi-rigid material, including but not limited to, a metal material, a ceramic material, a plastic material, a rubber material, composite material, or some combination thereof. The components are shown to be elongated with the recessed portion 103 being a generally oval type shape that is nestled within the housing aperture 121 of the housing 101. Thus, according to some aspects of the invention, the housing 101 may be positioned with the recessed portion 103 nestled into and adhered to the housing 101 such that the recessed portion 103 and housing 101 include a water tight bond and/or seal therebetween. The housing 101 and recessed portion 103 can then be positioned through or in an aperture of the housing 12 of the bathing environment 10 and secured to the bathing environment 10 via mounting apertures 104 in the housing 101. Caps 105 may be placed over the mounting apertures 104 after the housing is secured to the bathing environment 10 to prevent users from contacting edges of the mounting apertures 121 or fastening components contained therein. The caps 105 can also be used to improve the aesthetic look of the bathing environment 10.

Also shown in FIGS. 14-17 is a rotatable grab bar 106 having a handle portion 107, a leg portion 108, and a bridge portion 109. The handle portion 107 may comprise any material which assists the user in gripping the tool, such as knurling, specially shaped grooves, partially adhesive substances, any other materials known gripping mechanisms, or any combination thereof. The handle portion 107 as shown in the Figures has a curved (half-moon) shape, but may take on any known two-dimensional shape that facilitates use of the rotatable grab bar 106 or rotation about the central pivot pin 110. The leg portion 108 is typically a straight and rigid member that spans a length slightly more than the length of the housing aperture 121. The leg portion 108 contains at a central location a central bar aperture 113, the bridge portion 109 extending perpendicularly therefrom. The bridge portion 109 is hollow such that the threaded pivot pin 110 may be housed within the bridge portion 109 after assembly of the grab bar assembly 100.

The rotatable grab bar preferably includes a locking mechanism 114 to retain the grab bar 106 in the use and non-use positions. A nonlimiting example of the locking mechanism 114 is a system of components that operate similarly to a French door ball clasp, as is shown in the Figures. The components include a spring 115, a ball 116, and a washer 117. The components fit into a locking mechanism aperture 118 located at one of two junctions between the handle portion 107 and the leg portion 108 of the rotatable grab bar 106 such that the spring urges the ball 116 and the washer 117 outwardly from the grab bar housing. As will be understood, this outward urging will cause contact with a portion of the housing 101 to temporarily hold (or aid in holding) the bar in the use or non-use configuration. The locking mechanism aperture 118 is typically cylindrical in nature in order accommodate the ball and the spring. The spring is biased such that the ball extends at least partially away from an external surface of the leg portion 108. However, when the rotatable grab bar 106 is moved into the use configuration or the non-use configuration, the ball 116 is depressed into the locking mechanism aperture 118 where it creates a friction fit with the recessed portion 103. The friction fit created between the ball 116 and the recessed portion 103 generally resists or prevents the rotatable grab bar 106 from moving into or out of the use and non-use positions.

Figure 18A:
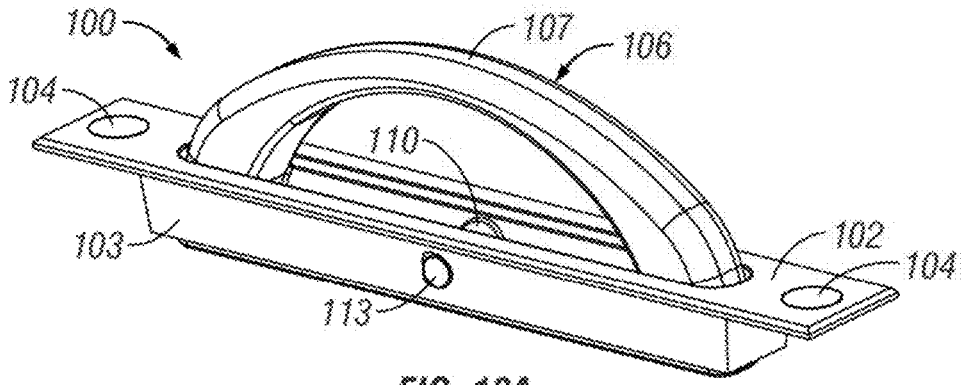
FIG. 18A is a front perspective view of the grab bar of FIG. 14 in a use configuration.
Figure 19A:
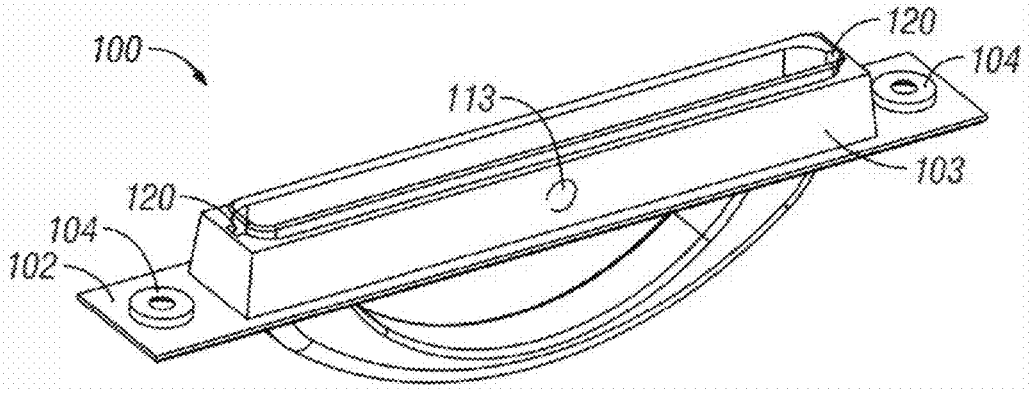
FIG. 19A is a rear perspective view of the grab bar of FIG. 18A.
Figure 20A:
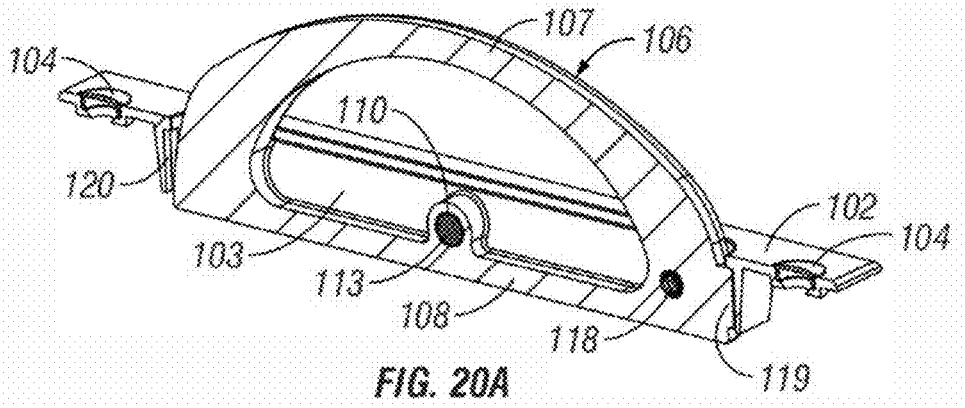
FIG. 20A is a sectional view of the grab bar of FIG. 18A.

FIGS. 18A, 19A, and 20A show the grab bar assembly 100 with the rotatable grab bar 106 in a substantially use configuration. The rotatable grab bar 106 for use with the grab bar assembly 100 is similar to that previously disclosed in that the rotatable grab bar 106 extends outward beyond a flange portion 102 of the housing 101 when in a use configuration so that a user may grip or hold onto the rotatable grab bar 106 while bathing or moving into or out of the bathing environment 10.

Figure 18B:
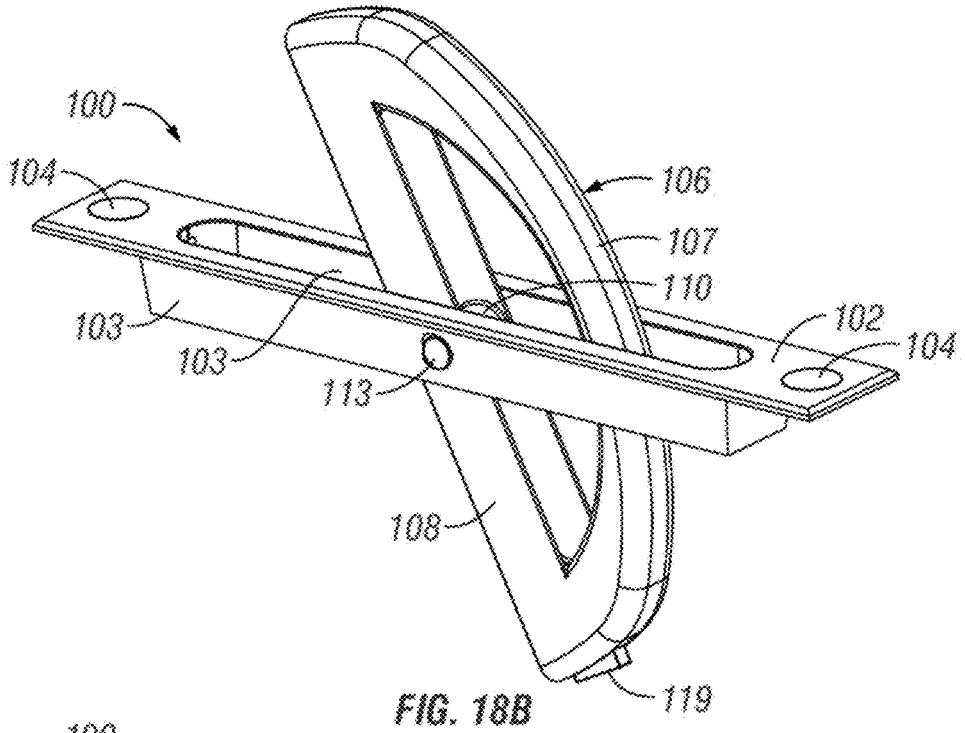
FIG. 18B is a front perspective view of the grab bar of FIG. 18A during transition into a non-use configuration.
Figure 19B:
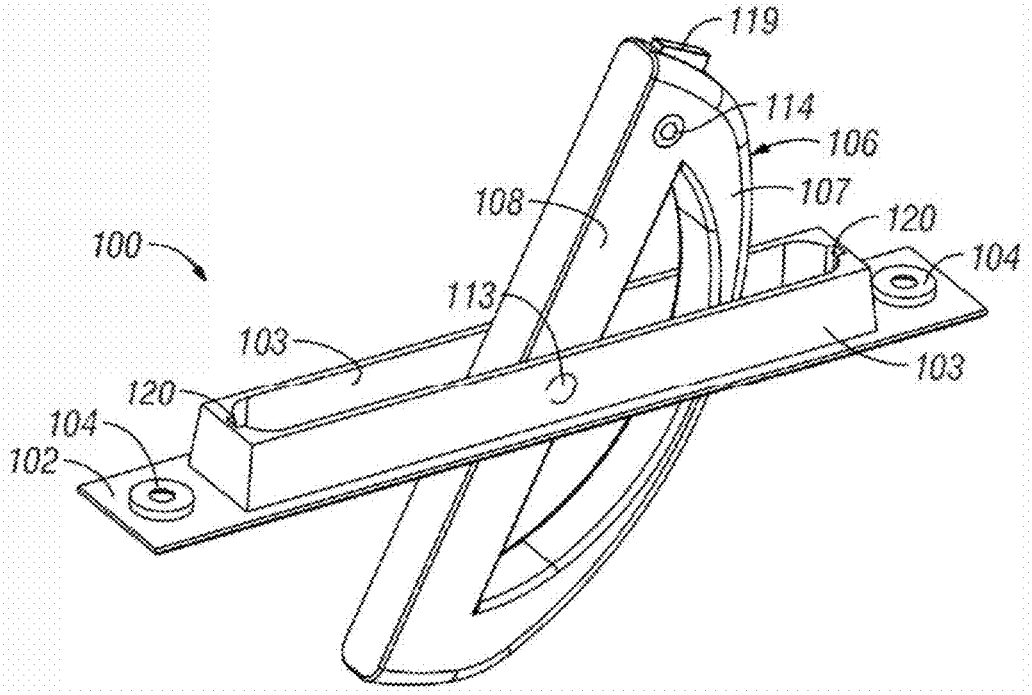
FIG. 19B is a rear perspective view of the grab bar of FIG. 18B.
Figure 20B:
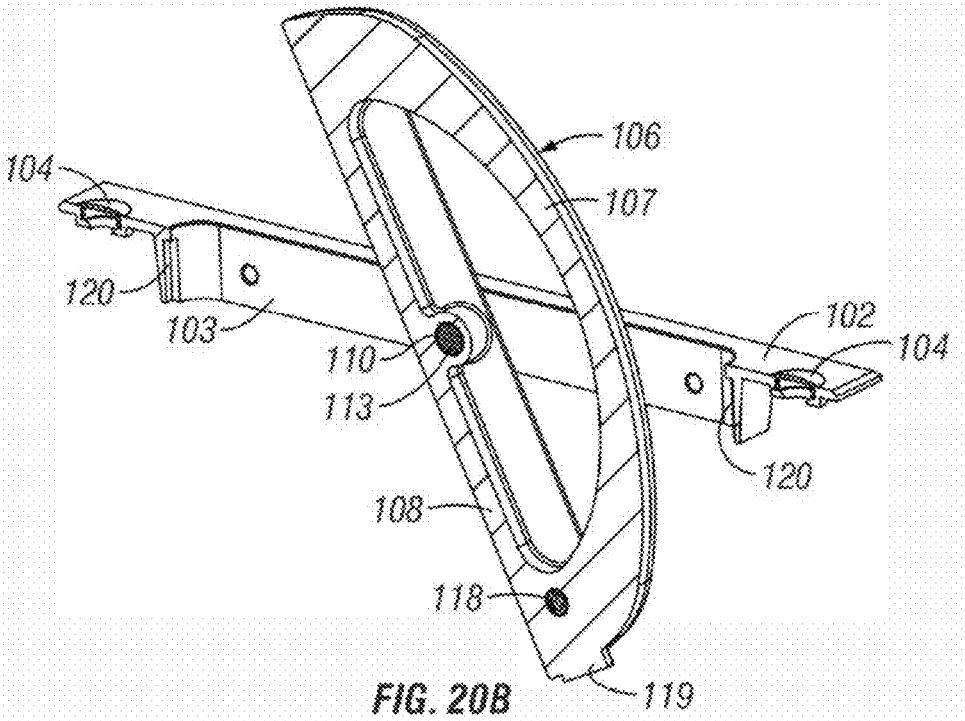
FIG. 20B is a sectional view of the grab bar of FIG. 18B.

FIGS. 18B, 19B, and 20B show the grab bar assembly 100 with the rotatable grab bar 106 in a substantially rotating configuration. The rotating configuration includes any position of the rotatable grab bar 106 in which the rotatable grab bar 106 is being rotated around a central, fixed, and threaded central pivot pin 110 and the rotatable grab bar is not in the designated use and non-use configurations. It should be noted that the rotatable grab bar 106 is not limited to rotating in a specific direction, and the components shown in the figures could comprise a mirror image of what is shown. For example, the rotatable grab bar 106 may rotate clockwise or counterclockwise to move from the use position into a non-use position.

In a preferred embodiment, the rotatable grab bar 106 includes a mechanical catch 119 which prevents the rotatable grab bar 106 from rotating more than 180°. When in the use configuration, the mechanical catch 119 rests against a corresponding notch 120 in the recessed portion 103 as shown in FIG. 19A. The rotatable grab bar 106 is then allowed to rotate 180° until the rotatable grab bar 106 mates with another notch 120 at the opposite end of the recessed portion 103 and the rotatable grab bar 106 is in the non-use configuration, as is shown in FIG. 19C.

Figure 18C:
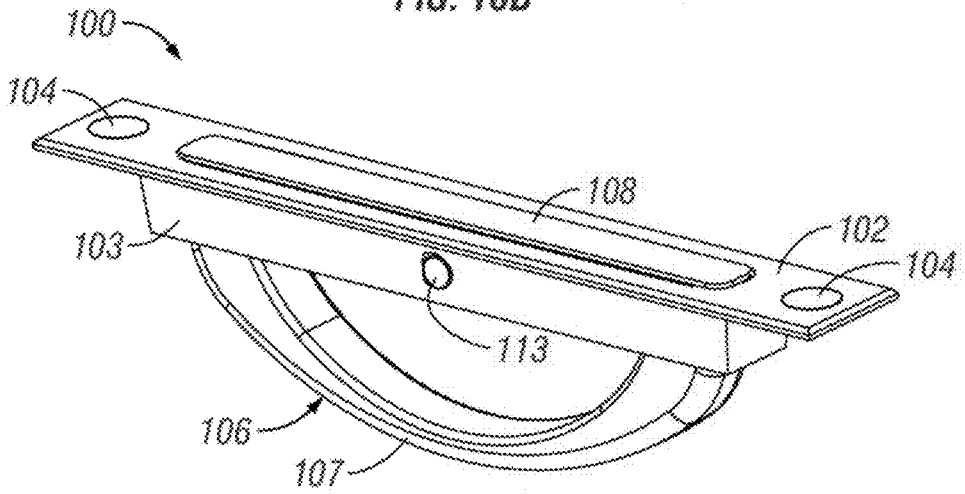
FIG. 18C is a front perspective view of the grab bar of FIG. 18A in a non-use configuration.
Figure 19C:
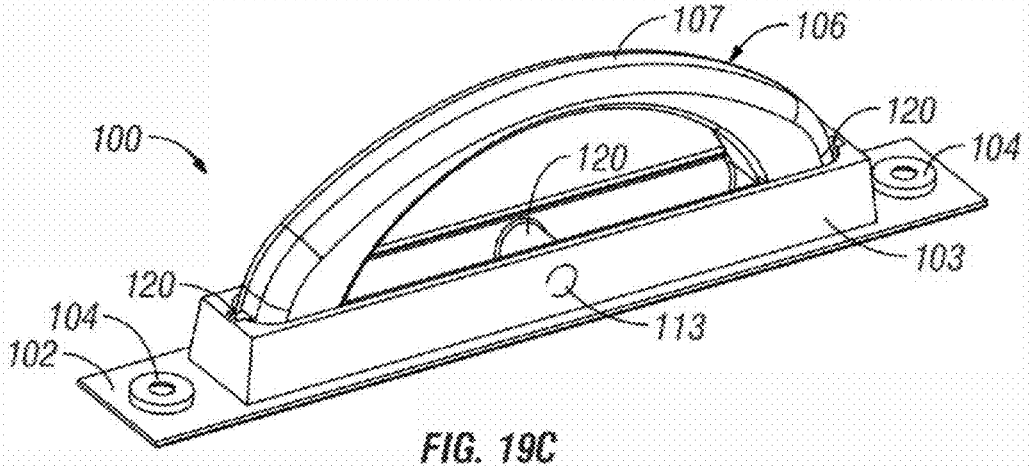
FIG. 19C is a rear perspective view of the grab bar of FIG. 18C.
Figure 20C:
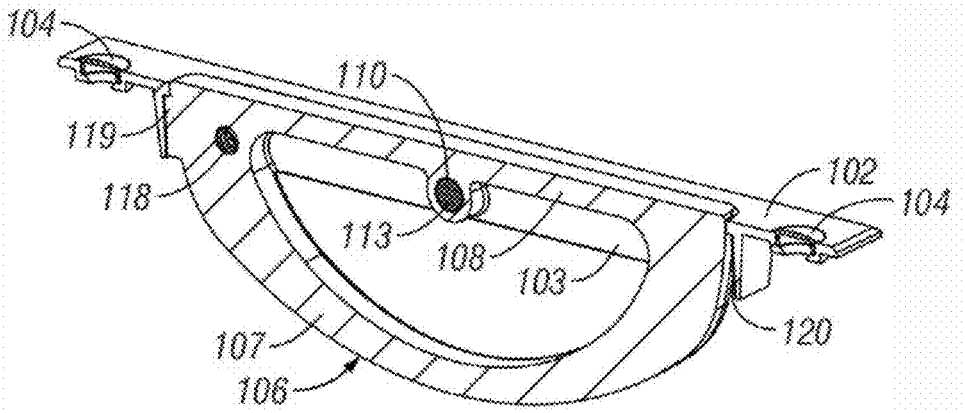
FIG. 20C is a sectional view of the grab bar of FIG. 18C.

FIGS. 18C, 19C, and 20C show the grab bar assembly 100 with the rotatable grab bar 106 in a substantially non-use configuration. In the non-use configuration, the rotatable grab bar 106 is positioned such that it is substantially within a recessed portion 103 of the housing 101, and therefore will not substantially extend outward of the recessed portion beyond a flange portion 102 of said housing 101. The housing 101 includes a recessed portion 103 generally extending away from the outwardly extending flange portion 102.

Still additionally, it is contemplated that the bathing environments used with the grab bars of the present disclosure could include a plate or cover that is selectively covering the bars. For example, when the bars, which could include generally any type of collapsible bar, are in the non-use configuration, the plate or cover could be extended to cover the bar so that it is essentially hidden from sight. The plate or cover could comprise a fiberglass or similar material that is similar to that of the bathing environment so as to blend in to aid in hiding the location of the collapsible bar. However, according to some aspects, the plate or cover comprises a decorative material such as metal, fiberglass, wood, faux material, composite or the like and could even be engraved or otherwise decorated to cover the bar in the collapsed position.

When needed the cover or plate would be removed, moved, or otherwise manipulated to allow access to the grab bar, such as by allowing a user to move the bars from the non-use to the use configuration. Therefore, the bars would only be accessible or accessed when needed, and the bathing environment, such as a wall, bathtub, spa, sauna, or the like, could be utilized and configured to look in different configurations.

The cover or plate could me slid into a portion of the housing or wall to provide access/cover for the grab bars, such as by having a portion of the cover on rails or grooves. The cover could be electronically configured to open/close, such as by sliding, rotating, tilting, or some combination, by the use of actuators or other members. Still other means of selectively accessing the grab bars via the cover or plate are contemplated.

It is to be further appreciated that the terms of the application are not to be limiting and all-inclusive. For example, while the terms use and non-use have been used in relation to the grab bars, it is to be appreciated that the bars could be used in their collapsed manner, such as by attaching an anchor, rope, or other device thereto to aid in use of the tether or other device. The bars need not be used in a bathing environment or any other specific environment for that matter.

For example, the grab bars may particularly be associated with any type of seat, including stadium seating, theater seating, boating, automobile seating, airline seating, outdoor seating, classroom seating, hospital seating, or the like. The bars may also act as concealable or retractable handles for movable objects and may be associated with reusable packaging, other moving materials, storage containers, luggage, laundry baskets, or the like.

According to another nonlimiting example, the bars may also act as concealable or retractable handles for substantially movable objects and may be associated with kitchen appliances, grills, doors, or the like.

According to another nonlimiting example, the bars can be used in the fitness industry to facilitate or resist certain types of exercises when mounted on a wall. The grab bars can flip over and be used with bands for stretching. The grab bars may be installed in the floor so that the grab bars may be gripped while a user does push-ups or other types of exercises where you are elevated to work your triceps or biceps.

According to another nonlimiting example, the grab bars can be used in closets at home or can be used in an office setting. The bar of the grab bars may be substituted for hooks and installed in a wall or other surface and when needed can be flipped into the use configuration so that clothes may be hung. When no longer needed, the hooks may be returned to the non-use configuration such that they are concealed and a flush surface is created. The hooks or grab bars may be installed within a concrete, outdoor wall, or other hard surface to create a place to tie a dog leash such that a dog does not have the ability to run away or attack persons passing by.

The bars could also be maintained in their extended configuration even when not in use. Furthermore, it is to be appreciated that additional holding and moving mechanisms could be used to move the bars between a generally extended and retracted or housed position.

From the foregoing, it can be seen that the present invention accomplishes at least all of the stated objectives.

LIST OF REFERENCE NUMERALS

The following list of reference numerals is provided to facilitate an understanding and examination of the present disclosure and is not exhaustive. Provided it is possible to do so, elements identified by a numeral may be replaced or used in combination with any elements identified by a separate numeral. Additionally, numerals are not limited to the descriptors provided herein and include equivalent structures and other objects possessing the same function.

10 walk-in-bathtub
12 housing
14 door
16 entrance
18 seat
20 interior wall
22 exterior wall
24 access panel
26 access panel
28 top surface
30 grab bar
32 drain
34 floor
40 grab bar assembly
42 housing
43 recessed portion
44 bar
45 aperture
46 first leg
47 flange portion
48 second leg
50 first aperture
52 second aperture
54 bar movement direction
60 grab bar assembly
62 housing
64 recessed portion
66 flange portion
68 first block
70 second block
72 bar
73 first leg
74 first vertical groove
75 second leg
76 first horizontal groove
78 second vertical groove
80 second horizontal groove
100 grab bar assembly
101 housing
102 flange portion
103 recessed portion
104 housing aperture
105 caps
106 rotatable grab bar
107 handle portion
108 leg portion
109 bridge portion
110 threaded pivot pin
111 recessed portion upper aperture
112 recessed portion lower aperture
113 central bar aperture
114 locking mechanism
115 spring
116 ball
117 washer
118 locking mechanism aperture
119 mechanical catch
120 notch
121 mounting apertures

What is claimed is:

1. A method of concealing and revealing a rotatable body support comprising:

housing the rotatable body support comprising a handle portion, a leg portion, and a central pivot pin within a grab bar housing having a recessed portion and a flange portion, said flange portion extending outwardly of the recessed portion and having a thickness less than a depth of the recessed portion; and allowing the rotatable body support to rotate approximately 180° around the central pivot pin between a use configuration and a non-use configuration, wherein in the non-use configuration the grab bar housing conceals the rotatable body support within an object surface of a building, a seat, or an appliance;

wherein the grab bar housing is mounted to the building, the seat, or the appliance such that at least a portion of the grab bar housing is flush with the object surface;

wherein a spring and ball are positioned within an aperture located at one of two junctions between the handle portion and the leg portion, wherein the two junctions are coplanar with one another and a shared surface of the handle portion and the leg portion, and further wherein a top of the aperture is located at the shared surface;

wherein the spring and ball lock, resist, or prevent the rotatable body support from moving out of the non-use configuration or the use configuration; and wherein the rotatable body support includes a mechanical catch for preventing the rotatable body support from rotating more than 180°.

2. The method of claim 1 wherein the handle portion extends outwardly from the flange portion when in the use configuration.

3. The method of claim 1 wherein the rotatable body support is at least partially within the recessed portion in the non-use configuration.

4. The method of claim 1 wherein the central pivot pin passes through a central bar aperture of the leg portion, a centrally located upper aperture in the recessed portion, and a centrally located lower aperture in the recessed portion.

5. The method of claim 4 wherein the central pivot pin is housed within a bridge portion centrally located in the leg portion.

6. The method of claim 5 wherein an end of the central pivot pin is male-threaded and the centrally located lower aperture is female-threaded.

7. The method of claim 1 further comprising locking, resisting, or preventing the rotatable body support from moving out of the non-use configuration or the use configuration.

8. The method of claim 1 wherein the recessed portion includes a notch at each end to receive the mechanical catch when the rotatable body support is in the use configuration or the non-use configuration.

9. The method of claim 1 wherein the surface carries a substantial load of the building, the seat, or the appliance.

10. The method of claim 1 wherein the flange portion and the recessed portion comprise a metal material, a ceramic material, a plastic material, a rubber material, composite material, or some combination thereof.

11. A grab bar assembly built into a surface comprising:

a grab bar housing including a recessed portion and a flange portion;

a rotatable body support comprising a handle portion, a leg portion, and a central pivot pin, the rotatable body support being rotatable around the central pivot pin between a use configuration and a non-use configuration; and a locking mechanism comprising, at least, a spring and ball, said locking mechanism positioned within an aperture located at one of two junctions between the handle and the leg portion, wherein the two junctions are coplanar with one another and a shared surface of the handle portion and the leg portion, and further wherein a top of the aperture is located at the shared surface;

wherein in the non-use configuration the rotatable body support is concealed within a wall of a structure, said structure being a building, a seat, or an appliance, and said wall carrying a load of the structure;

wherein the handle portion of the body support is at or below the surface when in the non-use configuration; and wherein the rotatable body support extends outward at least partially from the surface in the use configuration;

wherein said flange portion of the grab bar housing extending outwardly of the recessed portion and having a thickness less than a depth of the recessed portion to allow the housing to be attached substantially flush with the surface;

wherein the spring and ball lock, resist, or prevent the rotatable body support from moving out of the non-use configuration or the use configuration; and wherein the rotatable body support includes a mechanical catch for preventing the rotatable body support from rotating more than 180°.

12. The grab bar assembly of claim 11, wherein the central pivot pin passes through a central bar aperture of the leg portion, a centrally located upper aperture in the recessed portion, and a centrally located lower aperture in the recessed portion.

13. The grab bar assembly of claim 12, wherein the central pivot pin is housed within a bridge portion centrally located in the leg portion.

14. The grab bar assembly of claim 13, wherein an end of the central pivot pin is male-threaded and the centrally located lower aperture is female-threaded.

15. The grab bar assembly of claim 11 wherein the recessed portion includes a notch at each end to receive the mechanical catch when the rotatable body support is in the use configuration or the non-use configuration.

* * * * *